US007287654B2

(12) United States Patent
Nguyen et al.

(10) Patent No.: US 7,287,654 B2
(45) Date of Patent: Oct. 30, 2007

(54) BAG DISPENSING SYSTEM

(75) Inventors: Hank D. Nguyen, Metairie, LA (US); Francis B. Galle, Metairie, LA (US)

(73) Assignee: Advance Polybag, Inc, Sugar Land, TX (US)

( * ) Notice: Subject to any disclaimer, the term of this patent is extended or adjusted under 35 U.S.C. 154(b) by 385 days.

(21) Appl. No.: 10/837,884

(22) Filed: May 3, 2004

(65) Prior Publication Data

US 2004/0256279 A1 Dec. 23, 2004

Related U.S. Application Data

(63) Continuation of application No. 09/978,738, filed on Oct. 16, 2001, now Pat. No. 6,729,483, which is a continuation-in-part of application No. 09/956,768, filed on Jun. 19, 2000, now Pat. No. 6,505,750, and a continuation-in-part of application No. 29/120,858, filed on Mar. 28, 2000, now Pat. No. Des. 435,379, and a continuation-in-part of application No. 29/120,859, filed on Mar. 28, 2000, now Pat. No. Des. 433,857.

(51) Int. Cl.
*A47F 5/00* (2006.01)

(52) U.S. Cl. ..... 211/163

(58) Field of Classification Search ..... 211/163, 211/12, 85.15, 181.1, 205; 248/95, 99, 100
See application file for complete search history.

(56) References Cited

U.S. PATENT DOCUMENTS 1,657,737 A 1/1928 Bogren
3,144,960 A 8/1964 Membrino
3,190,490 A 6/1965 Membrino
3,306,492 A 2/1967 Kugler
3,361,294 A * 1/1968 Bjerum ..... 221/26
3,918,589 A * 11/1975 Nausedar ..... 211/57.1
4,487,318 A 12/1984 Roen
4,611,719 A * 9/1986 Dudek et al. ..... 211/50
4,932,560 A * 6/1990 Roen ..... 211/57.1 X
5,332,097 A * 7/1994 Wile ..... 206/554
5,419,437 A * 5/1995 Huseman ..... 206/554
5,732,833 A * 3/1998 Alvarado et al. ..... 211/59.1
5,924,573 A * 7/1999 Piraneo et al. ..... 206/554
5,941,392 A * 8/1999 Huang et al. ..... 206/554
6,065,233 A * 5/2000 Rink (Continued)

*Primary Examiner*—Sarah Purol
(74) *Attorney, Agent, or Firm*—Joseph T. Regard, Ltd plc

(57) ABSTRACT

A bag and system for dispensing thermoplastic bags or the like from a stack of bags. The present system is configured for point of use dispensing to a customer, such as in the produce section of a grocery store or market. Each bag pack is dispensed from a station which includes an underlying, medially situated, angled bag pack support, configured to provide optimal support for the user in opening and removing the bag to be dispensed from the bag pack. Further contemplated is a unique cover which partially envelopes the bag pack to be dispensed, the cover defining an opening formed therethrough for the dispensing of bags therethrough, the opening configured to define the area for optimal dispensing of the bags while maintaining the remaining bags in a uniform bag pack. The cover not only facilitates uniform dispensing of bags from the pack, but also holds the pack down when the system is used in windy conditions.

15 Claims, 27 Drawing Sheets

U.S. PATENT DOCUMENTS

D433,857 S * 11/2000 Nguyen
6,142,302 A * 11/2000 Requena ..... 206/554
6,264,059 B1 * 7/2001 Requena ..... 221/45
6,505,750 B1 * 1/2003 Nguyen ..... 211/163

* cited by examiner

FIG. 10A
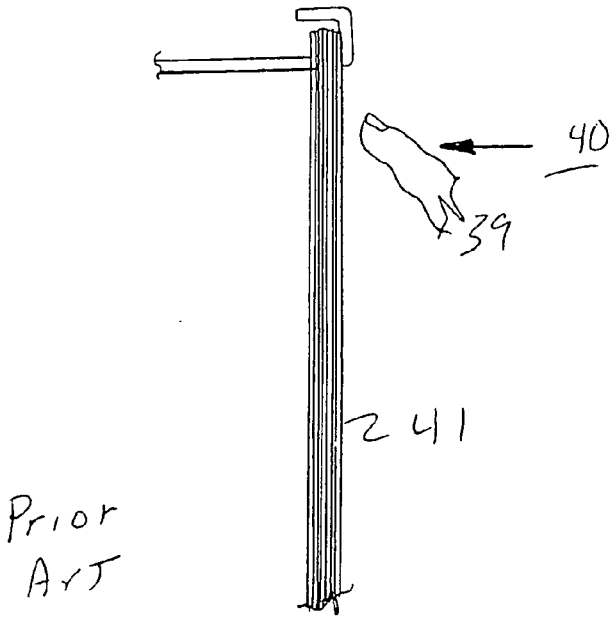
FIG. 10B
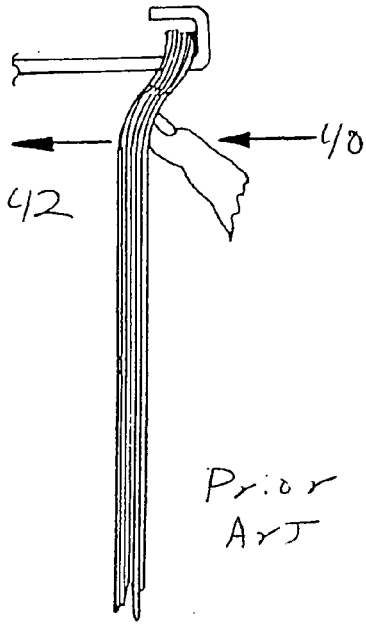
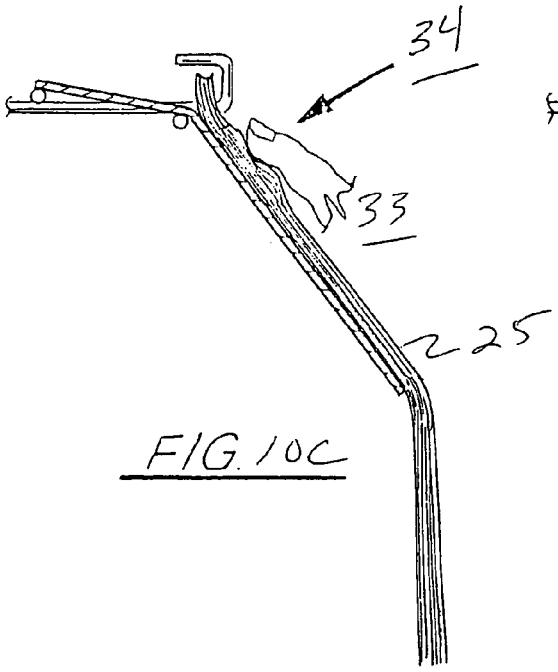
FIG. 10C
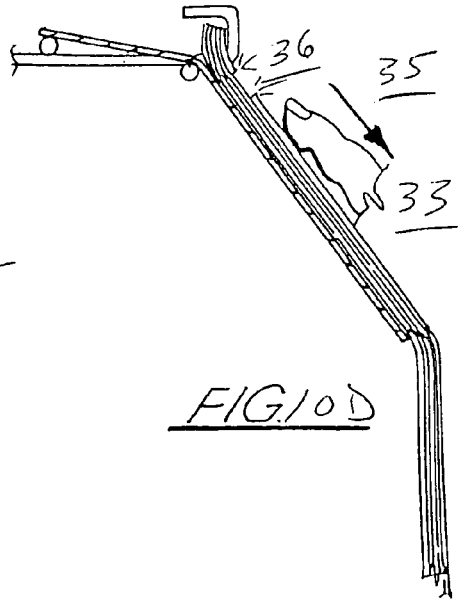
FIG. 10D

BAG DISPENSING SYSTEM

STATEMENT OF CONTINUING APPLICATIONS

This application is also a continuation in part of U.S. Utility application Ser. No. 09/978,738 filed Oct. 16, 2001, now U.S. Pat. No. 6,729,483 which was a continuation in part of U.S. Utility application Ser. No. 09/596,768 filed Jun. 19, 2000 now U.S. Pat. No. 6,505,750 and was a continuation-in-part of U.S. Design Application 29/120,858 filed Mar. 28, 2000, now U.S. Pat. No. D,435,379 and U.S. Design Application 29/120,859, filed Mar. 28, 2000 now U.S. Pat. No. D,433,857 each said application listing Hank Duc Nguyen as inventor, and having the title "Produce Bag Dispensing Rack".

TECHNICAL FIELD OF THE INVENTION

The present invention relates to bag dispensing systems, and particularly to a bag and system for dispensing thermoplastic bags or the like from a stack of bags. The present system is configured for point of use dispensing to a customer, such as in the produce section of a grocery store or market.

The preferred, exemplary embodiment of the present system teaches a free standing bag dispensing stand configured to hold at least a single pack of produce bags, but which may include as many as four or produce bag packs of equal or different sizes. Each bag pack is dispensed from a station which includes an underlying, medially situated, angled bag pack support, configured to provide optimal support for the user in opening and removing the bag to be dispensed from the bag pack.

Further contemplated is a unique cover which is placed over the bag pack to be dispensed, the cover having an opening formed there through for the dispensing of bags there through, the opening configured to provide optimal dispensing of the bags while maintaining the remaining bags in a uniform bag pack. The cover may include advertising, and may include a pocket or retaining means for allowing the placement of notices, advertising thereupon, or holding means for allowing the dispensing of coupons or bag ties therefrom. The cover not only facilitates uniform dispensing of bags from the pack, but also holds the pack down when the system is used in windy conditions.

BACKGROUND OF THE INVENTION

Produce bags are dispensed directly to customers at produce counters or the like, where the customer can bag the produce as it is chosen for purchase. A common problem with dispensing produce bags is providing the bag to the consumer in a convenient, simple, and reliable fashion. Further considerations relate to ease of replenishing the supply, uniformity of dispensing, ease of opening, and providing closure means such as bag ties or the like. Prior art patents have contemplated various dispensers for produce bags, including rolls of unfolded or folded bags, dispensing boxes, and stands, which may be wall mounted for free standing.

U.S. Pat. No. 5,732,833 issued 1998 teaches a free standing plastic bag dispenser for dispensing packs of produce bags or the like, wherein the bag packs are hung on folded plastic tab members and supported by a single, wide, medially situated hook (18A). A horizontally situated backing bar (16) for maintaining the packs "in a substantially planar condition which is pleasing to the eye". FIG. 8 illustrates a bag pack having a perforated tab which is heat sealed at insertion points (22*e*), the tab having formed therein first and second apertures (27) for receiving first and second support hooks (18').

While the prior art has contemplated a free standing produce bag stand for dispensing individual bags from a pack of produce bags, it would appear that the prior art has failed to teach a produce bag dispensing system which includes an angled medial support member to aid in removing the top most bag from the stack.

GENERAL SUMMARY DISCUSSION OF THE INVENTION

Unlike the prior art, the present invention provides a bag dispenser system which is comparatively strong and reliable, while being inexpensive to manufacture, requiring little in the way of custom manufacturing equipment, while being consistent in performance and quality.

Prior art systems for produce bag dispensers for dispensing individual bags from a pack of bags are found to have shortcomings relating to the expense of manufacture and the ease of use. Specialized tabs for supporting the bag packs add material and labor costs to the product, as well as requiring specialized racks for holding the packs. Hanging the bag pack presents additional problems in dispensing the top most bag, as the hanging pack lacks support, and a user pressing against the top most bag in an attempt to retrieve same must pinch and grab the bag to pull it, as applying pressure to the bag simply results in the bag pack being pushed back. When the user must pinch and grab the bag, all to often more than one bag at a time is dispensed, and the additional bags often end up on the floor, resulting in waste and a potential safety hazard.

What is therefore required is a bag rack which is provides a stable platform for the dispensing of produce bags, so that a user may easily and with little instruction dispense a single, top bag from the pack.

The present invention provides the stability lacking in the prior art by adding an angled support member medially situated between first and second support hooks, the support member providing a stable platform upon which a user may apply pressure to the top bag of the pack, and pulling toward the user, the bag is dispensed without the necessity of pinching the bag pack and pulling the pack toward the user, which, as above disclosed, can result in more than one bag being dispensed.

In order to further aid dispensing of the top most bag from the bag pack, a cover having some mass is provided to provide a weighted top layer over the bag pack, the cover having formed therein a dispensing aperture which guides the user to the optimal portion of the bag for dispensing same, wherein the user contacts the top most bag within the confines of the aperture formed in the cover, and, by pressing down upon the top most bag and directing said pressure toward the consumer, the bag pack is supported by the underlying medial support member, and the top most bag is detached from the pack and dispensed through the aperture to the customer consistently as a single bag with relative reliability and ease. The cover has the additional purpose of preventing the bag pack from blowing in wind, while securing the bag pack in a flat, uniform fashion.

It is therefore an object of the present invention to provide an improved system for dispensing individual thermoplastic bags or the like.

It is another object of the present invention to provide a perforated, solid fused tab having a first and second handle support apertures formed therein for accepting first and second support hooks on the rack.

It is still another object of the present invention to provide a bag dispensing system which requires little significant equipment modification, while providing a consistent quality, strong and aesthetically acceptable product.

It is another object of the present invention to provide a bag rack which includes a medial support member for providing angled support of the dispensing area of the pack.

It is another object of the present invention to provide a cover configured to be used with the bag pack and rack of the present invention, wherein the support cover has formed there through a dispensing aperture configured to guide the user to the optimal portion of the top bag for dispensing from the bag rack.

It is still another object of the present invention to provide a cover which protects the bag pack while maintaining the bag pack in a flat, uniform, fashion even under windy conditions.

Lastly, it is an object of the present invention to provide a bag pack which is easily loaded upon a rack, providing a consistent and reliable dispenser for produce bags or the like.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIGS. 10A-10B illustrate prior art designs of a bag rack, and the removal of a bag therefrom.

FIGS. 10C-10D illustrate removal of the bag pack from the present invention of FIG. 9.

DETAILED DISCUSSION OF THE INVENTION

Figure 1:
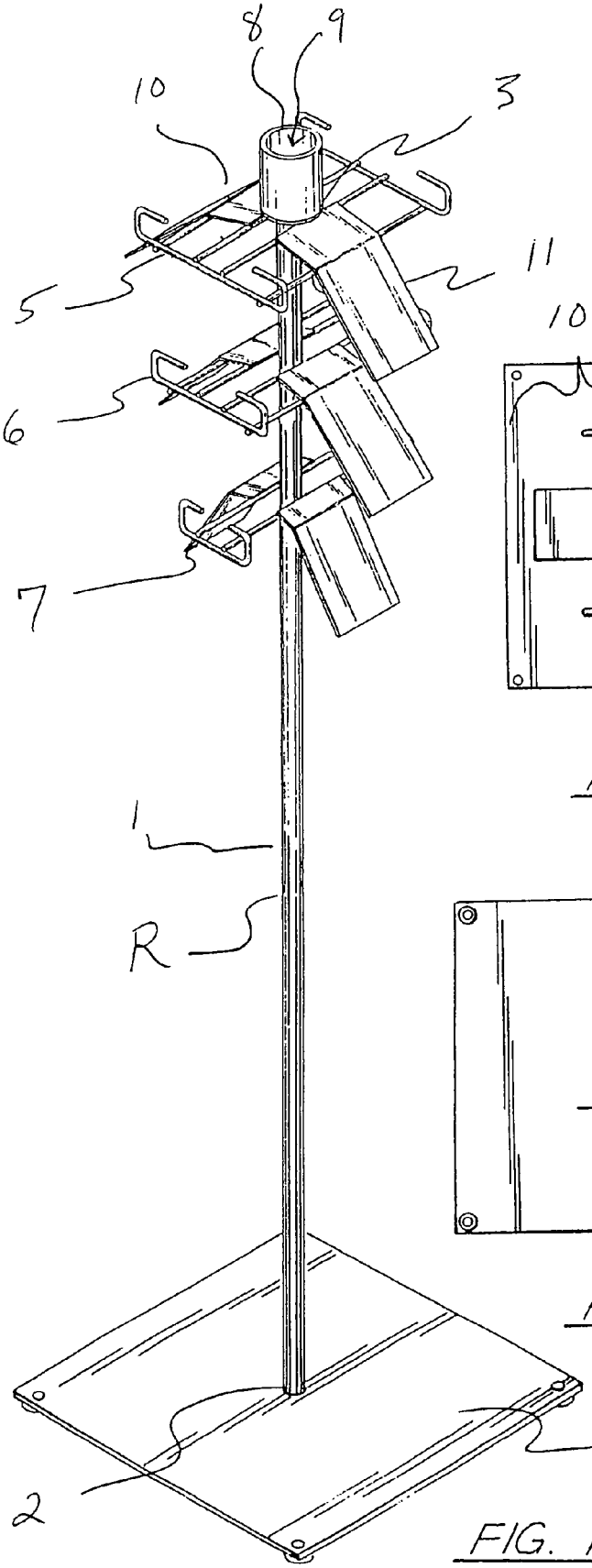
FIG. 1 is an isometric, side view of the preferred embodiment of the rack of the present invention.
Figure 2:
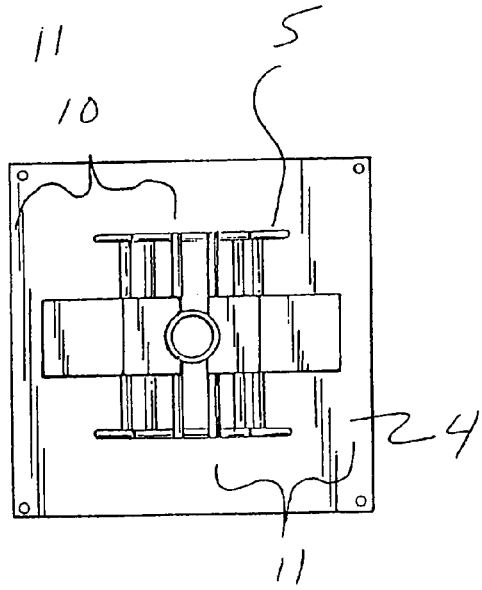
FIG. 2 is a top view of the rack of FIG. 1.
Figure 3:
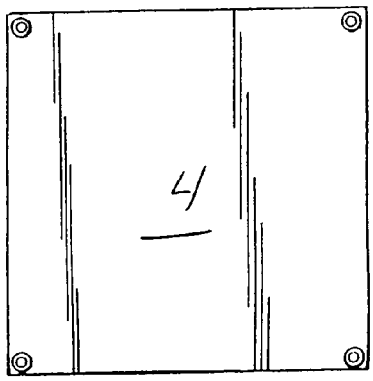
FIG. 3 is a bottom view of the rack of FIG. 1.
Figure 4:
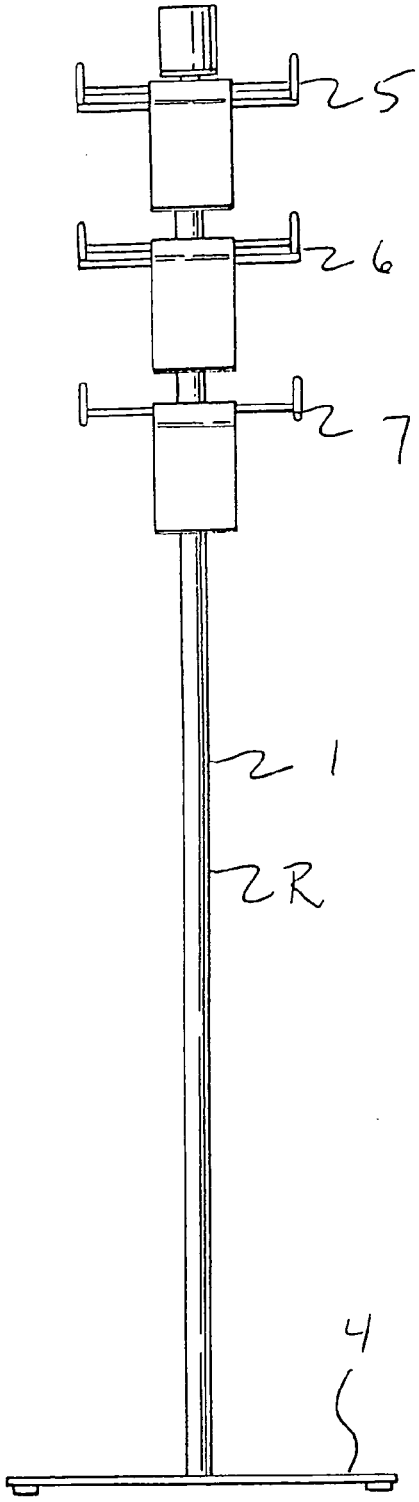
FIG. 4 is a side view of the rack of FIG. 1.
Figure 5:
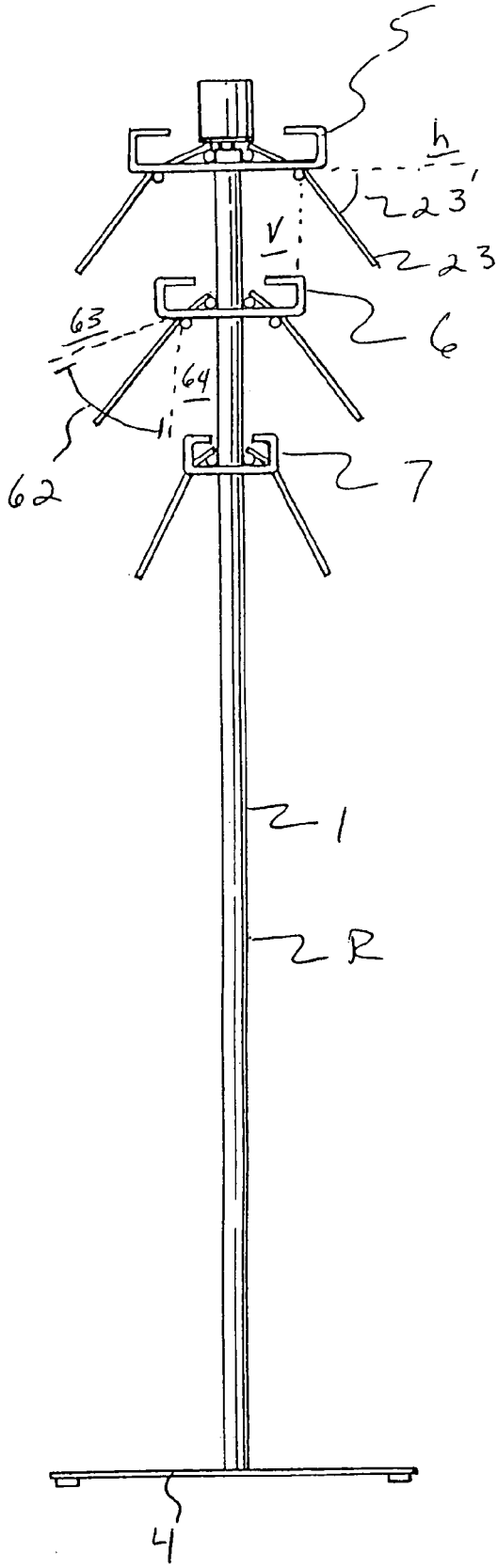
FIG. 5 is an end view of the rack of FIG. 1.
Figure 6:
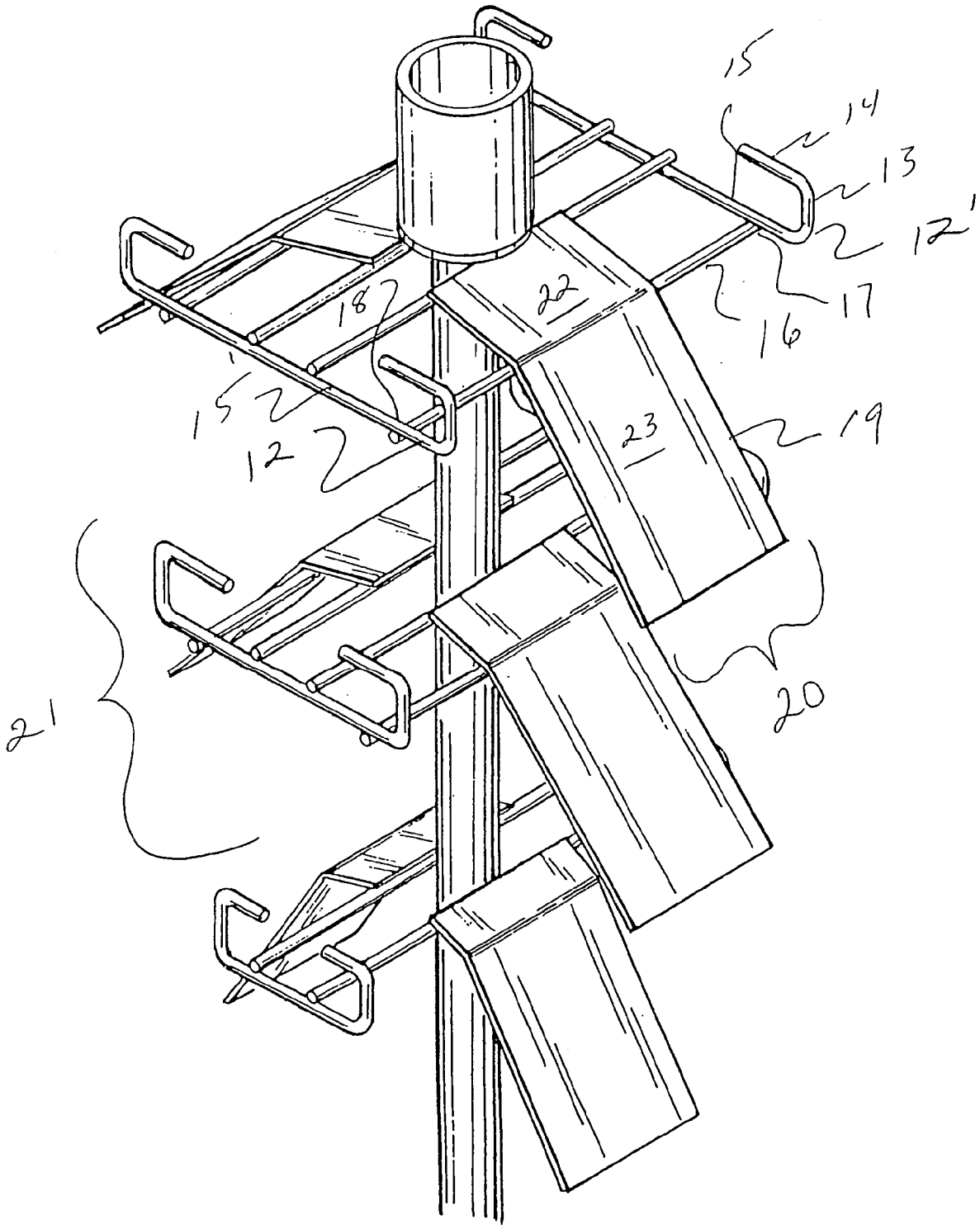
FIG. 6 is an isometric view of the upper portion of the rack of FIG. 1.

As can be seen in FIGS. 1-9, the rack R of the present invention includes a vertical support member 1 having first 2 and second 3 ends, the first end 2 engaging a base 4, the second end 3 supporting a top rack 5, medial rack 6, and lower rack 7. Situated upon the top rack 5 is a tie dispenser 8 which includes a receptacle 9 for the placement of bag ties or the like therein.

Each rack 5, 6, or 7 includes first 10 and second 11, opposing dispenser stations situated on a common horizontal plane, each dispenser station having a base formed of wire and supporting first 12 and second 12' support hooks, each of the hooks including a generally vertical portion 13 communicating with an upper, rearwardly directed hook member 14. Situated between the first and second dispenser stations are horizontal support rods 15, 15', the first 12 and second 12' support hooks having situated there between a medial support bar 16 having first 17 and second 18 ends communicating with said horizontal support rods 15', 15, respectively.

Supported by said medial support bar 16, between said first 12 and second 12' support hooks is a medial planar support member 19 having a width 20 and a length 21, an upper horizontal area 22 and a declining, planar support area 23 or piece emanating from the medial support bar 16. As shown, the declining planar support area 23 may have an angle 23' of, for example, forty-five degrees relative to the horizontal H or vertical V, although operational ranges 62 of declination of the planar support area may range widely, for example about five degrees 63 to about ninety degrees 64, relative to the horizontal. Further, the width of the declining planar support area 23 may vary depending upon the application and size bag to be dispensed, although the width should be sufficient to enable a user to easily utilize same to support the bag pack during dispensing of the top bag, as will be more fully discussed infra; an exemplary width of the declining support area may be, for example, about four inches.

The present system further includes a bag pack 24 comprising a stack of bags including a top bag 25, each bag having a uniform width and length 26. The bags are retained in a pack via a heat fused tab portion 27 removably connected to the upper edge forming the mouth of the bag, via perforated line 28, the tab portion further having second and first support apertures 30', 30 or slits formed there through, configured to engage first and second hooks 12, 12', respectively.

Figure 7:
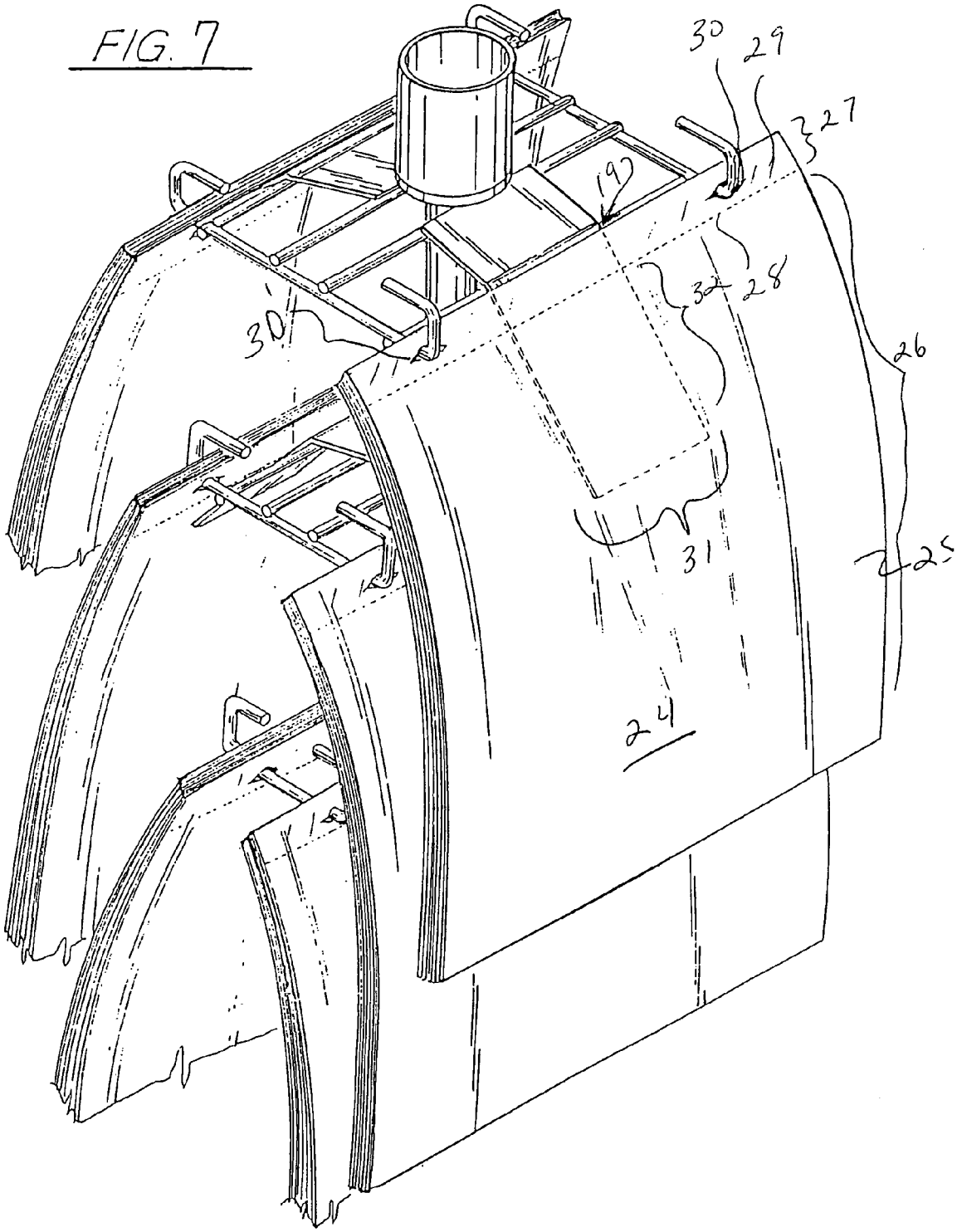
FIG. 7 is an isometric view of the rack of FIG. 1 having bag packs loaded thereupon.
Figure 8:
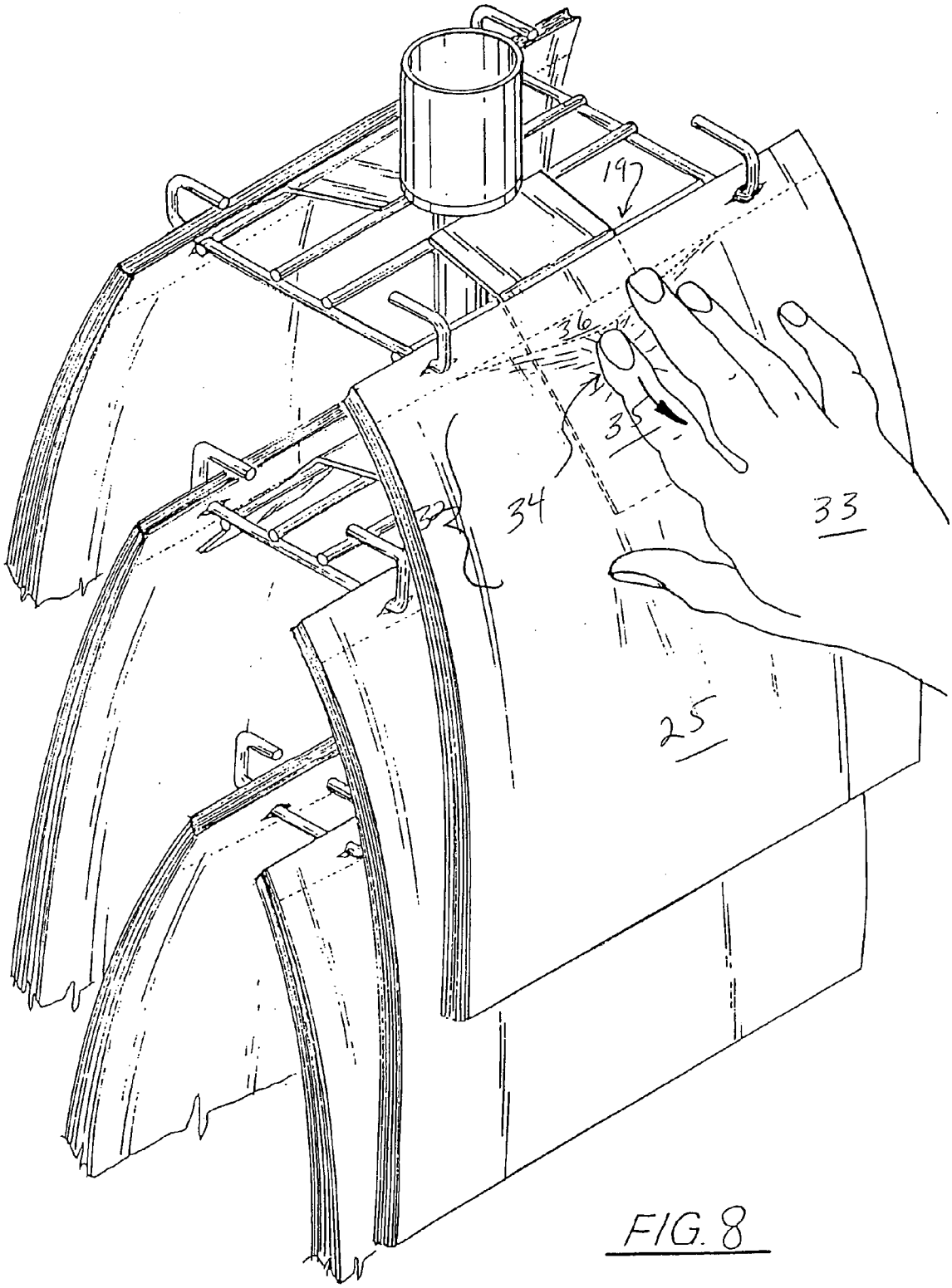
FIG. 8 is an isometric view of the rack of FIG. 7, illustrating the dispensing of a top bag from one of the bag packs.
Figure 9:
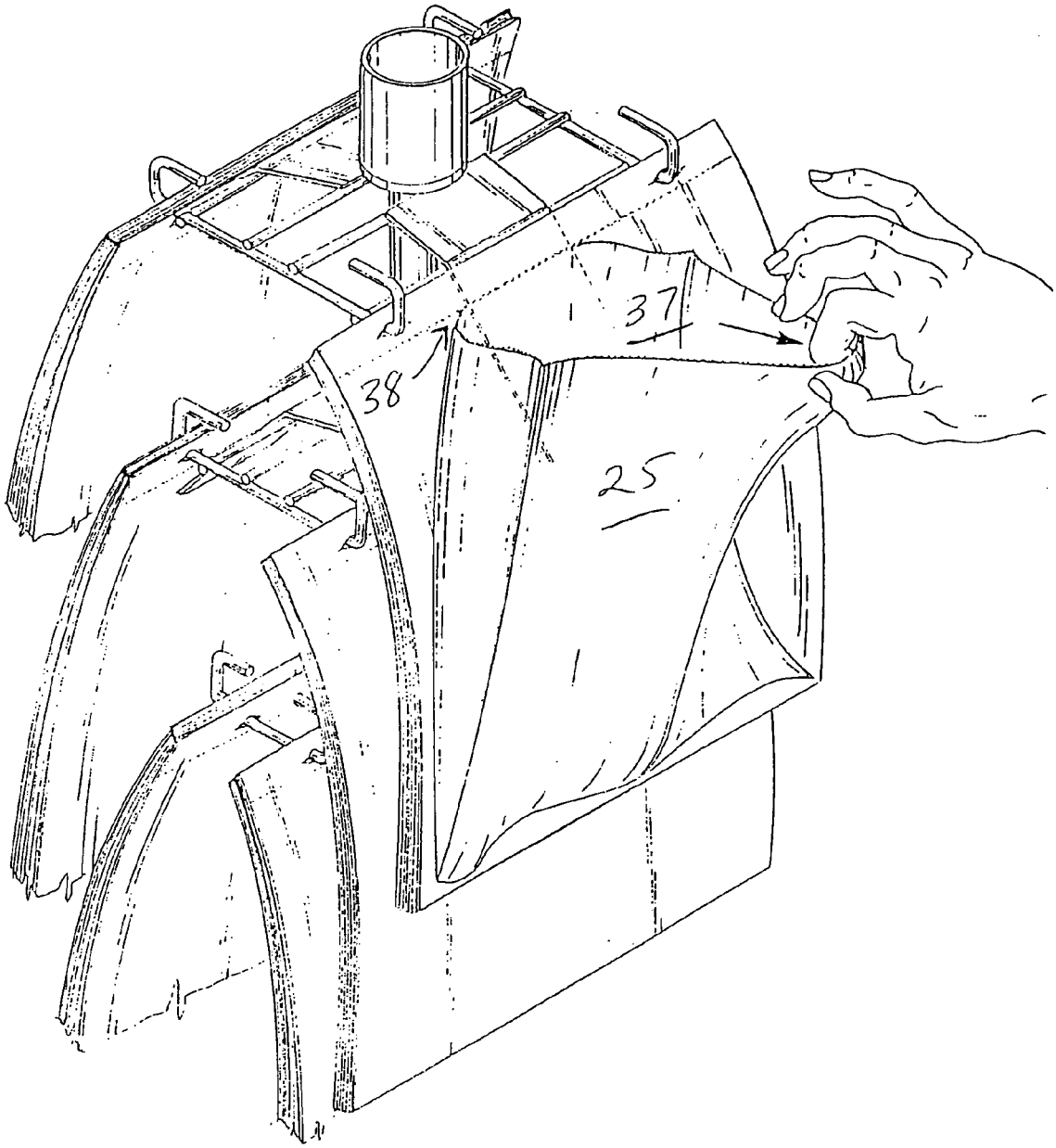
FIG. 9 is an isometric view of the rack of FIG. 8, illustrating the removal of a top bag from the bag pack.

Continuing with FIGS. 7-9, the upper medial area 31 of the bag pack 24 is supported in declining angled fashion via the declining planer support area of the medial planer support member 19, providing a supported dispensing area 32 on the bag pack for enhanced dispensing of individual bags from the bag stack by a user.

In use, the user 33 applies pressure 34 to the top bag within the supported dispensing area 32 over the planer support, so that the underlying declining planer support area of the medial planer support member 19 supports the medial area 31 and supported dispensing area 32 of the bag and bag pack, allowing the user to pull 35 the top wall of the bag toward the user, separating 36 the perforated portions, opening bag 37, and removing and dispensing 38 same from the pack. This supported dispensing via the support member 29 offers advantages over prior art systems, shown in FIGS. 10A and 10B, which did not provide the underlying support of the present invention. As shown, when a user 39 applied pressure 40 to a prior art bag pack 41, the pack, not being supported in an underlying fashion, would likewise move back 42, and the user would be left with attempting to separate the top wall of the bag from the pack, and pinching and pulling same to remove the top bag form the pack, a process which could prove frustrating and could result in multiple bags being inadvertently removed from the pack at one time. Often the extra dispensed bags would be left to fall upon the floor, where they could pose a slip hazard, or simply be wasted as not being used.

Figure 11A:
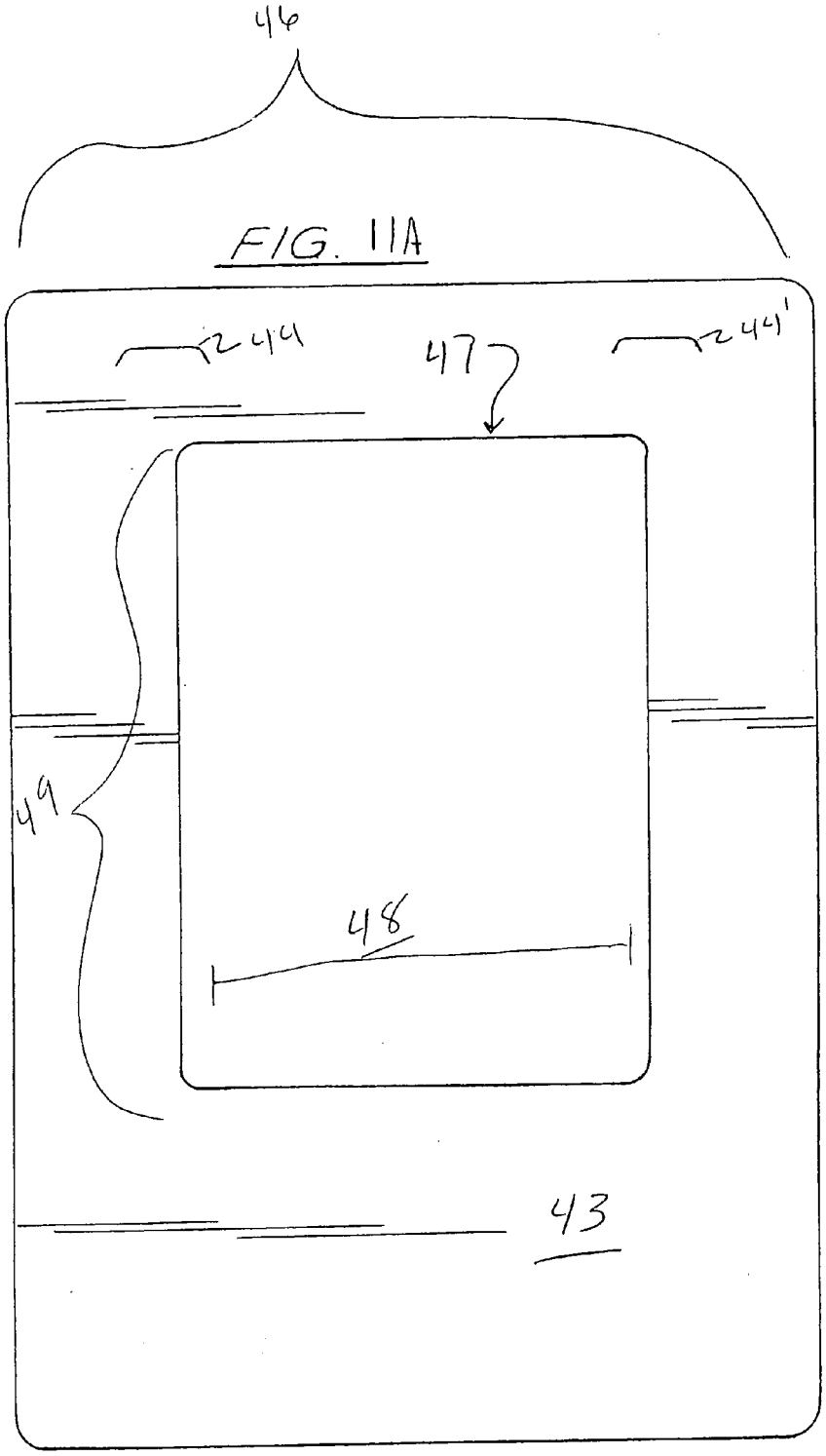
FIGS. 11A-11C illustrate frontal, side, and end views, respectively, of a cover configured to be used with the system of FIG. 9.
Figure 11B:
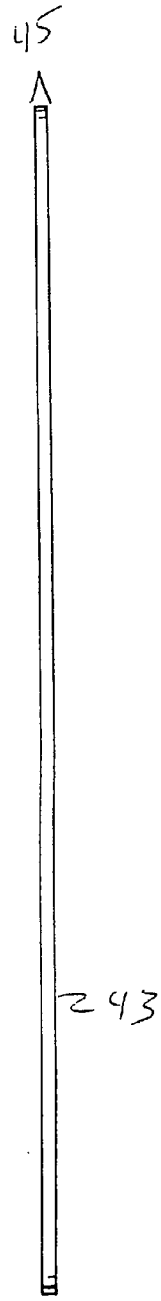
Figure 11C:
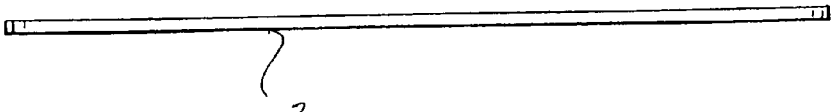

FIGS. 11A-11C illustrate a cover which may be used to further enhance dispensing of individual bags from a bag pack utilizing the present system, wherein the cover 43, which may be formed a flexible material, such as, for example, polyethylene, polyurethane, or the like, has ideally a width 46 and length generally commensurate to that of the underlying bag pack, as well as a thickness 45 to provide some mass to the cover to retain it atop the bag pack. The cover may include a material or additive which urges the thermoplastic forming the bags in the bag pack to cling via electrostatic charge to the cover, for enhanced releasable bonding of the cover to the bag pack.

The cover has formed therein a dispensing aperture 47 having a width 48 and a height 49, which may be commensurate with the measurements of the declining planer support area of the bag rack, the cover having first 44 and second 44' support apertures configured to engage the first and second support hooks of the rack.

Figure 12A:
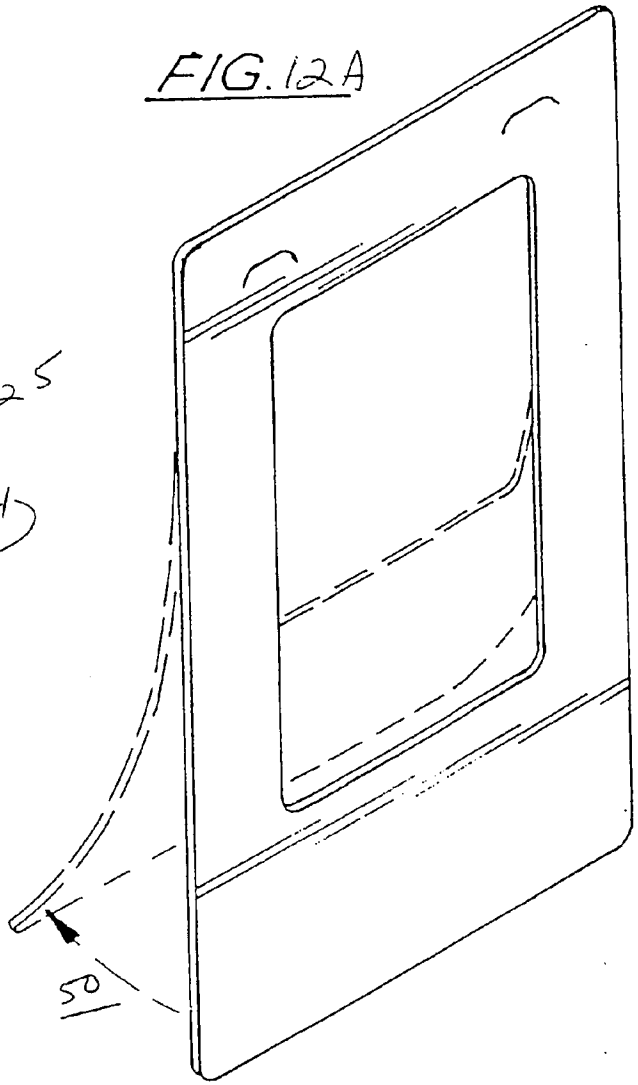
FIGS. 12A-12B illustrate isometric and installed views of the cover of FIGS. 11A-11C, installed upon a rack for dispensing.
Figure 12B:
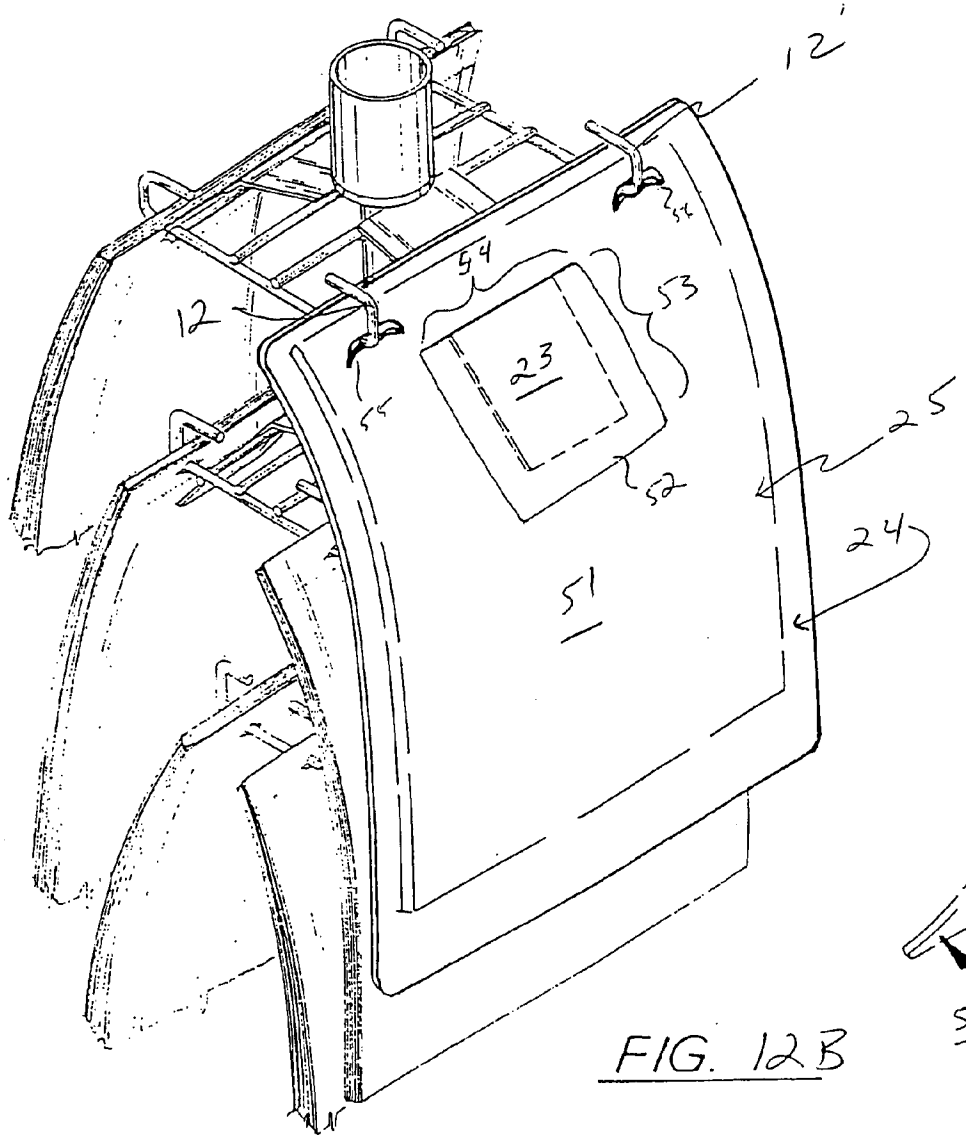
Figure 13B:
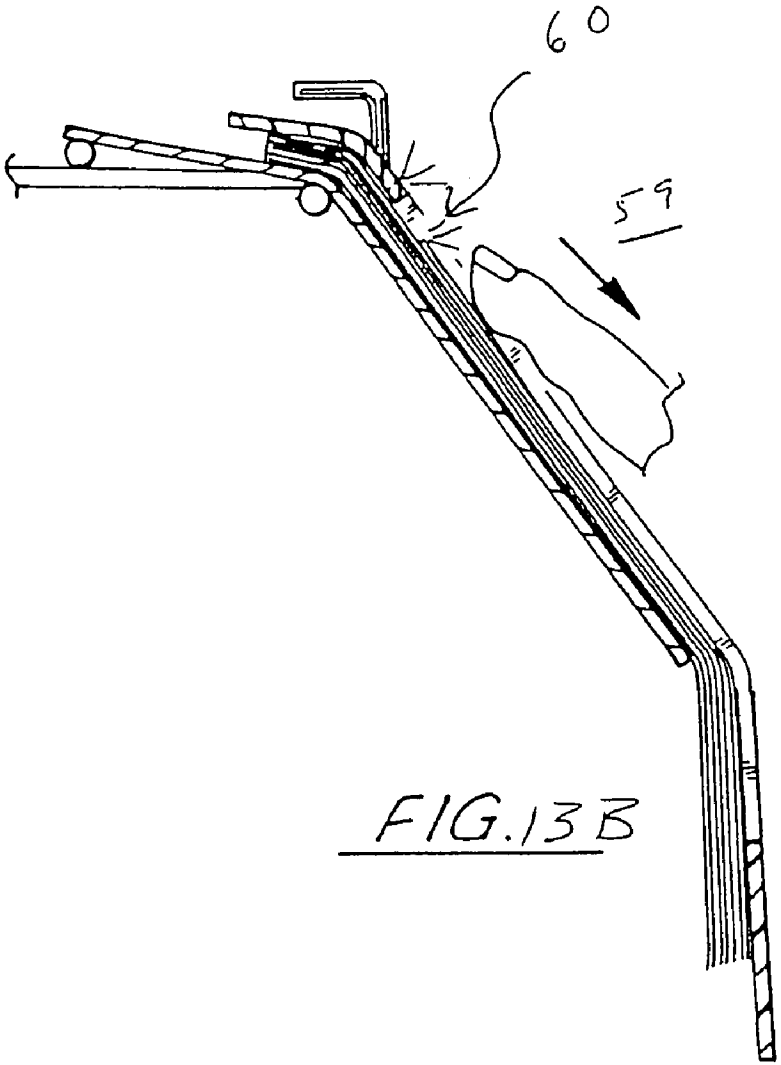
FIGS. 13A-13D illustrate sequential side views of the dispensing of a top bag from the bag pack utilizing the rack, bag pack, and cover of FIG. 12B.
Figure 13A:
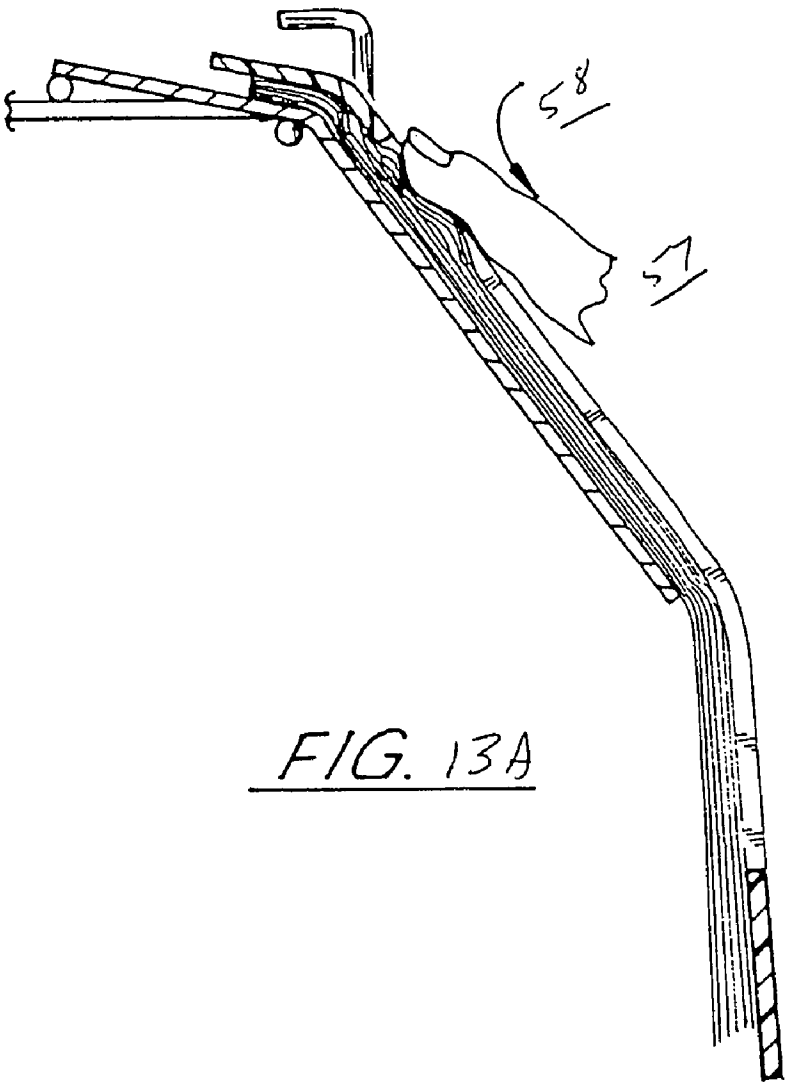
Figure 13C:
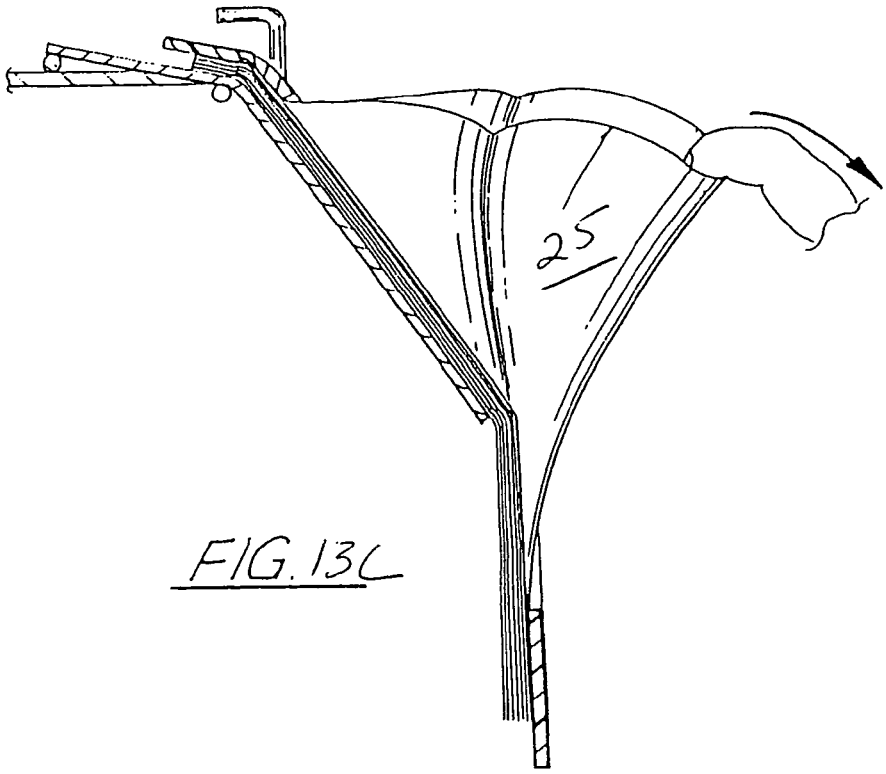
Figure 13D:
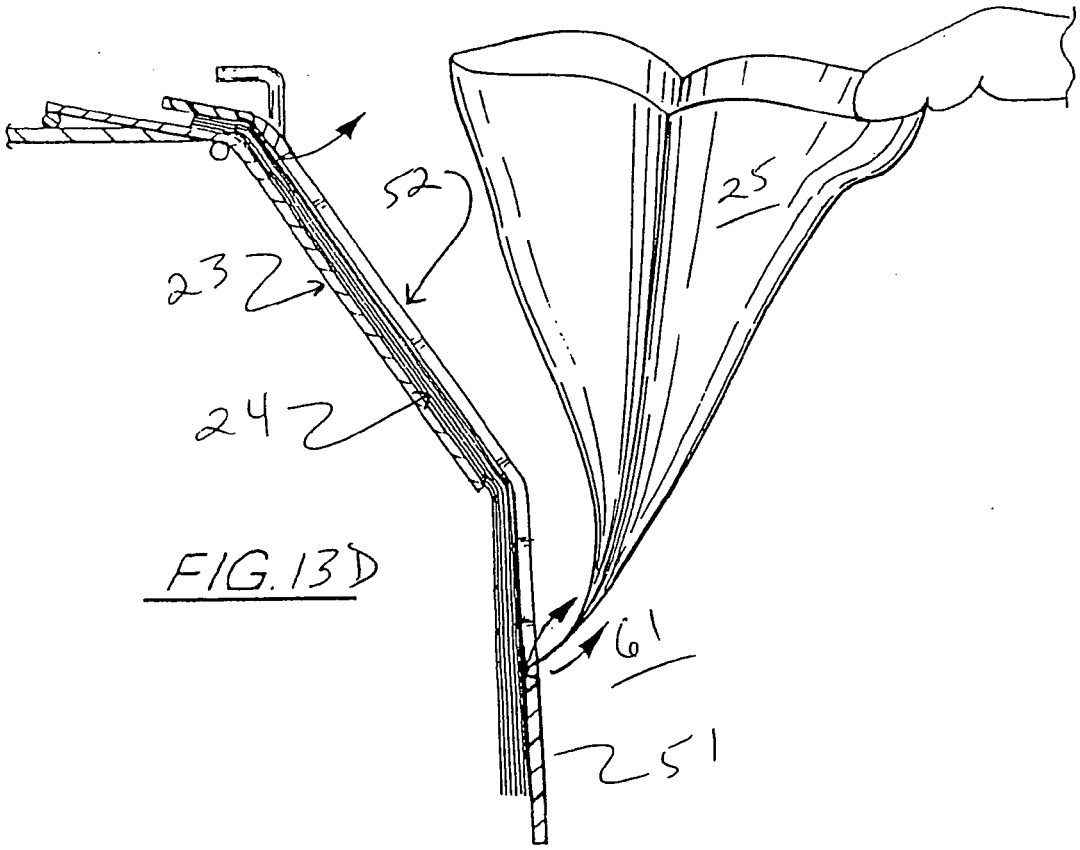
Figures 14A, 14B, 14C:
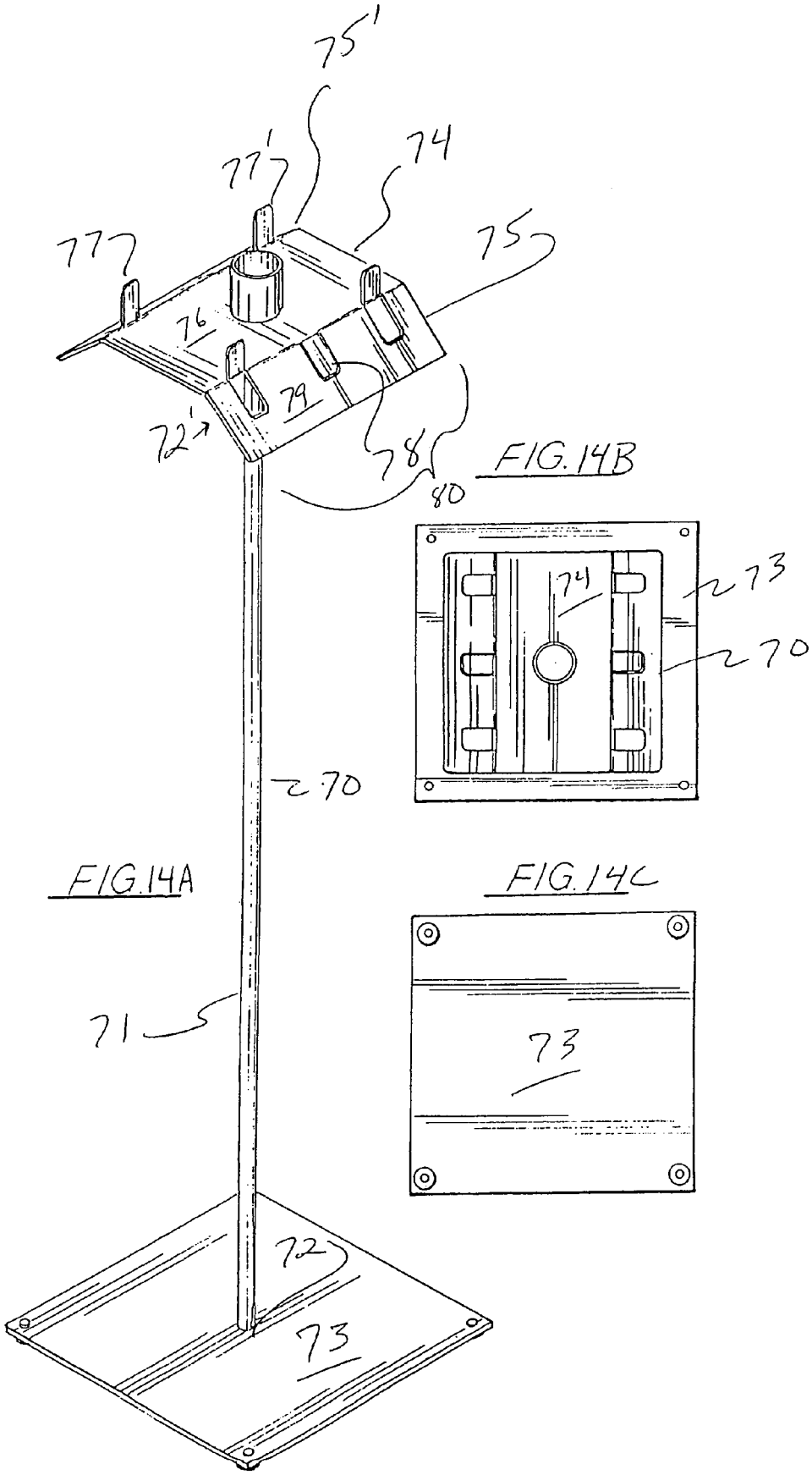
FIGS. 14A-14E illustrate isometric, top, bottom, side, and end views of an alternative embodiment of a rack to the invention of FIG. 1.
Figure 14D:
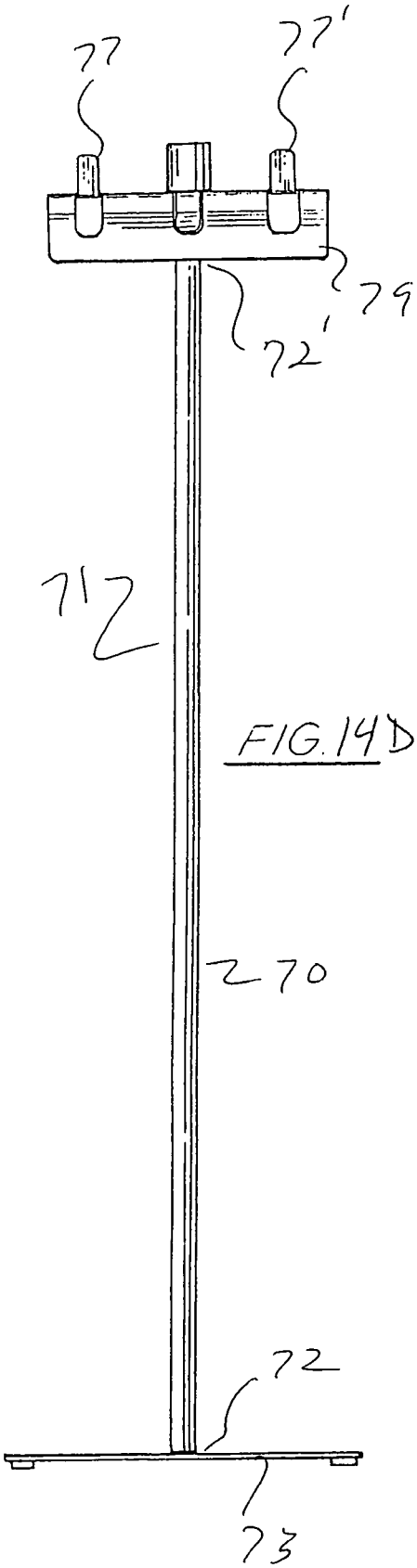
Figure 14E:
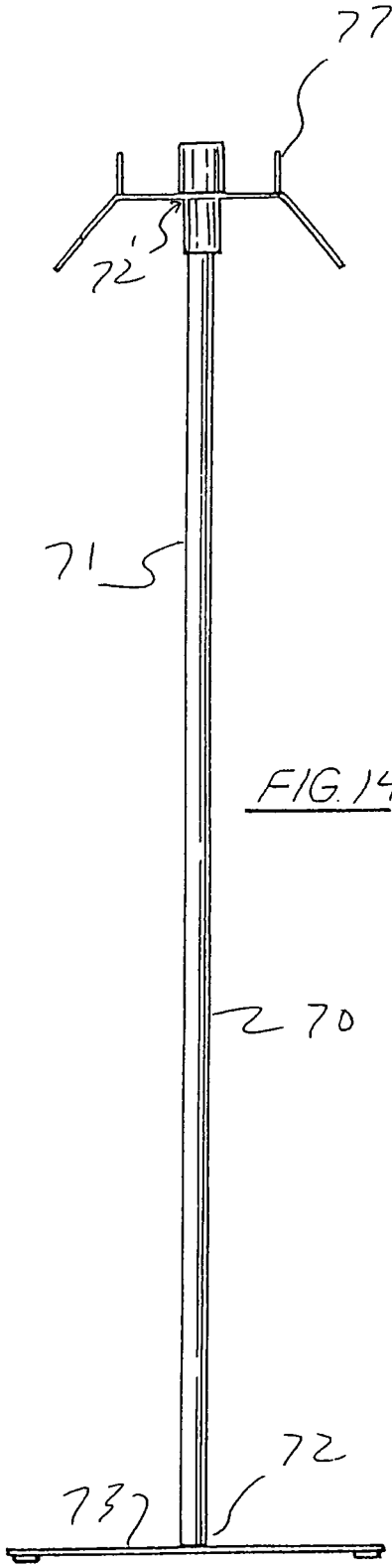

Continuing with FIGS. 12A and 12B, the cover 51 rests upon the bag pack, engaged to the rack via support apertures 55, 56 engaging support hooks 12, 12', respectively, and the dispensing aperture 52 is situated above the declining planer support area 23 of the medial planer support, centered generally medially in the upper area of the bag pack 24 and top bag 25. As indicated, ideally, the dispensing aperture 52 should ideally have a length 53 and width 54 commensurate with the size of the declining planer support area 23, so that a user, when seeking to dispense a bag, must contact the bag via the dispensing aperture, and thereby receive underlying support from the declining planer support area 23. As shown, the cover should ideally be flexible 50 so that it conforms to the shape of the bag pack on the rack.

Figure 16B:
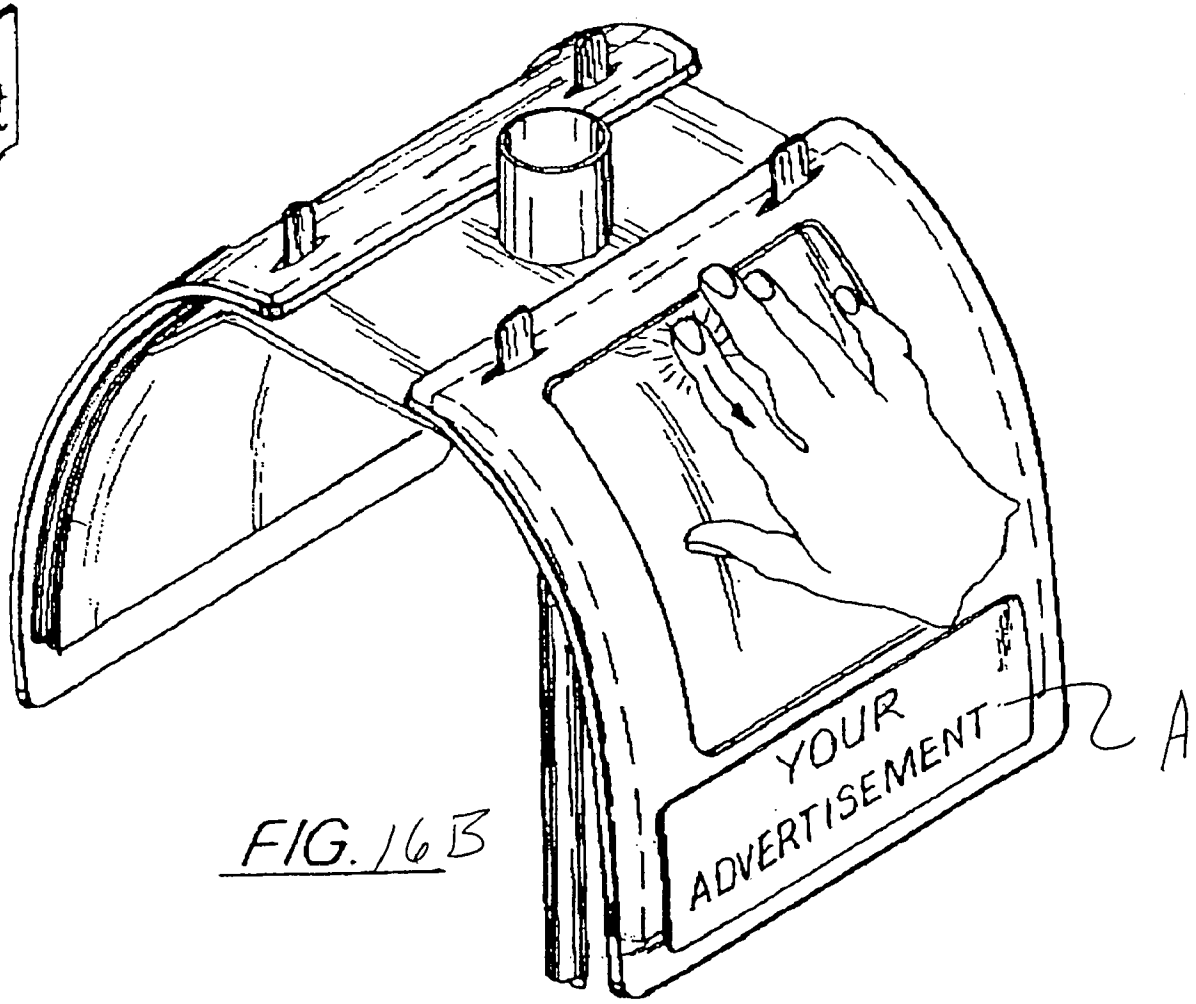
FIGS. 16A-16B illustrate isometric views of alternative cover designs to the system of FIGS. 11A-11C.
Figure 16A:
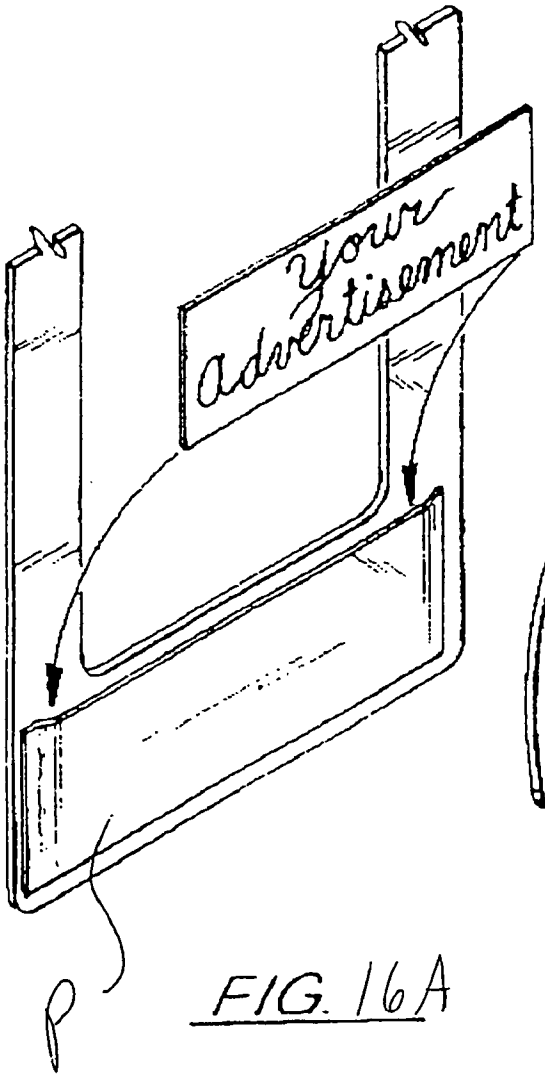
Figure 17B:
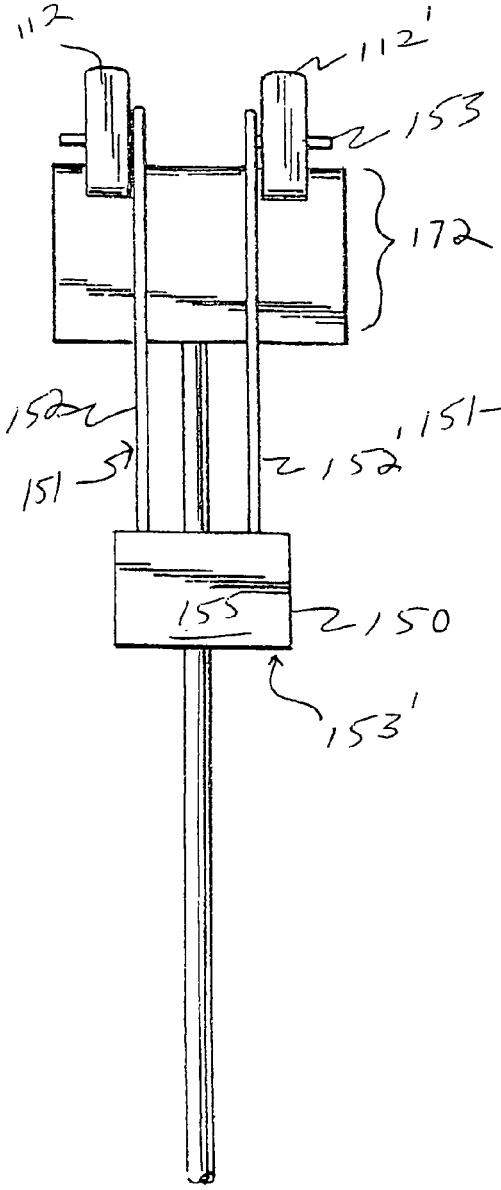
FIG. 17B is an end view of the bag rack of FIG. 17A.
Figure 17A:
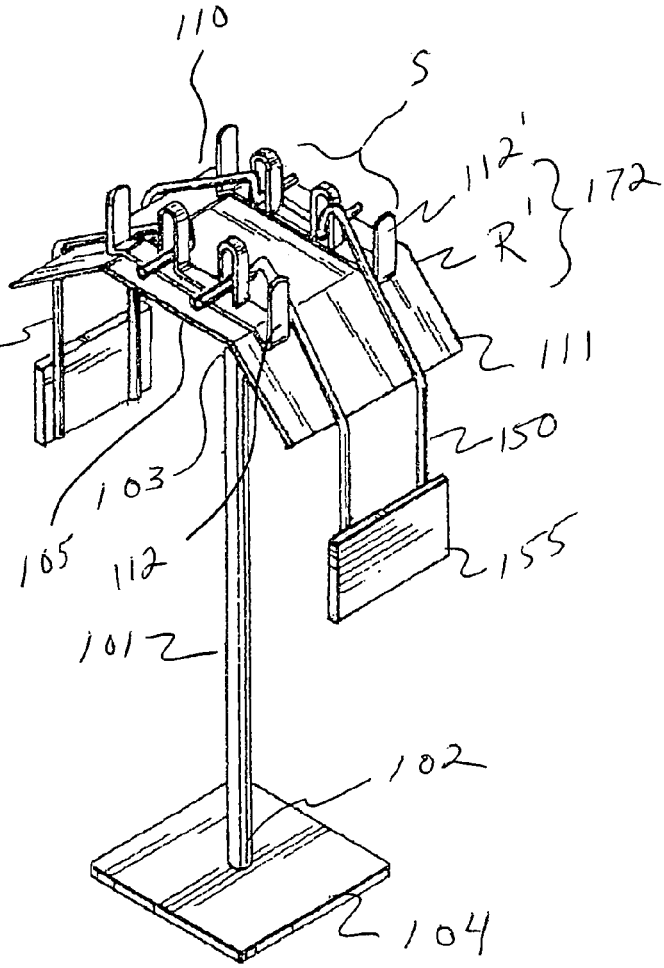
FIG. 17A illustrates an isometric view of a third embodiment of the present invention, illustrating a rack having first and second bag pack holding sections, each said section having a bag pack cover comprising first and second rods pivotally connected to the bag rack at one end, and a lower cover plate at the second end, with a dispensing area defined between the first and second rods.
Figure 17C:
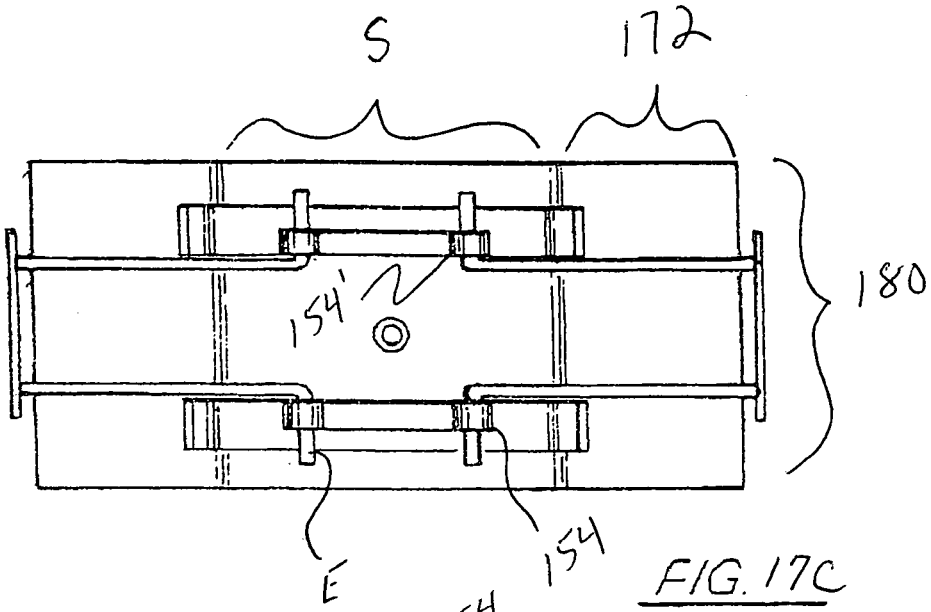
FIG. 17C is a top view of the bag rack of FIG. 17A.
Figure 17D:
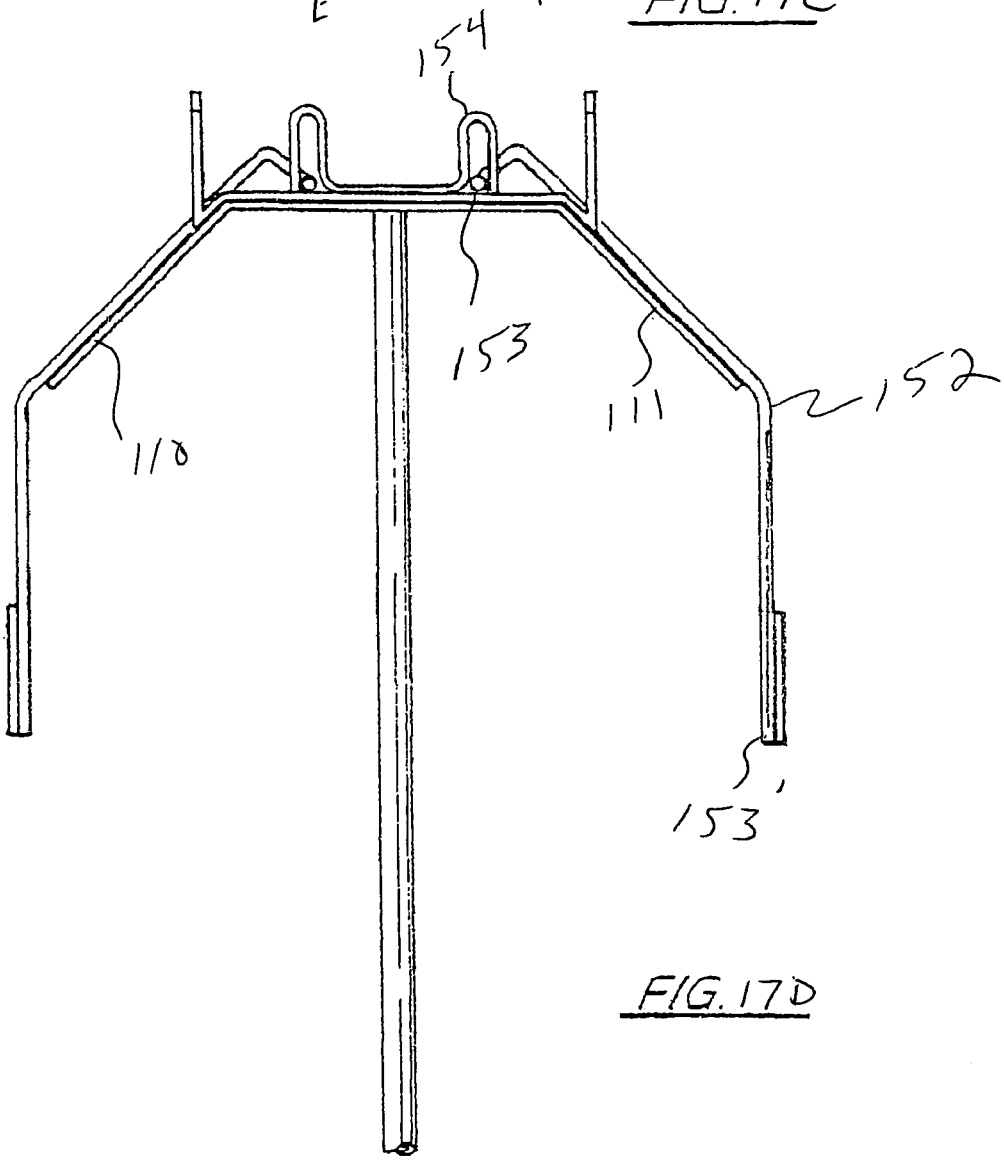
FIG. 17D is a side view of the bag rack of FIG. 17D.

As shown in FIG. 16B, the cover may include advertising A, or, as shown in FIG. 16A, the cover may include a pocket P or retaining means for allowing the placement of notices, advertising thereupon, or holding means for allowing the dispensing of coupons or bag ties therefrom.

Referring to FIGS. 13A-13D, the user 57 applies pressure 58 downward to the top bag in the bag pack through the dispensing aperture formed in the cover, utilizing the declining planer support area 23 to support the bag pack 24 and top bag 25, guiding the bag downward 59, urging the perforation apart and thereby separating 60 the bag from the tab, opening the mouth of the bag 25. The cover, besides framing the area which the user can effectively utilize the declining planer support area to dispense the top bag, also functions to apply pressure to the bag pack and bag being dispensed, holding via pressure 61 the bag pack in a flat, uniform position while the top bag is dispensed. The cover also holds the pack in a flat, uniform posture under windy conditions. It is noted that the dispensing aperture may have forms other than the rectangle shown, and may include other designs, including those incorporating radial lines, depending upon the application and use of the system.

FIGS. 14A-14E illustrate an alternative design embodiment for the rack of the present invention, wherein the stand 70 includes a vertical support 71 having first 72 and second 72' ends, the first end engaging a base 73, the second end engaging a rack portion 74, the rack portion further including first and second, opposing dispensing portions 75, 75', respectively. As shown, the body 76 of the rack is formed from sheet metal which is bent into shape, and which has punched out bag pack support member 77, 77' configured to engage and hold the bag pack in a manner similar to that indicated in the preferred embodiment of the invention. As shown, a third, medial support member 78 may be provided, depending upon the configuration of the pack to be dispensed.

Continuing with the drawings, the rack includes a declining planar support member emanating from the body at about the position of the support member 77, 77', which ideally would have a width 80 commensurate with the width of the bag pack to be dispensed.

Figure 15A:
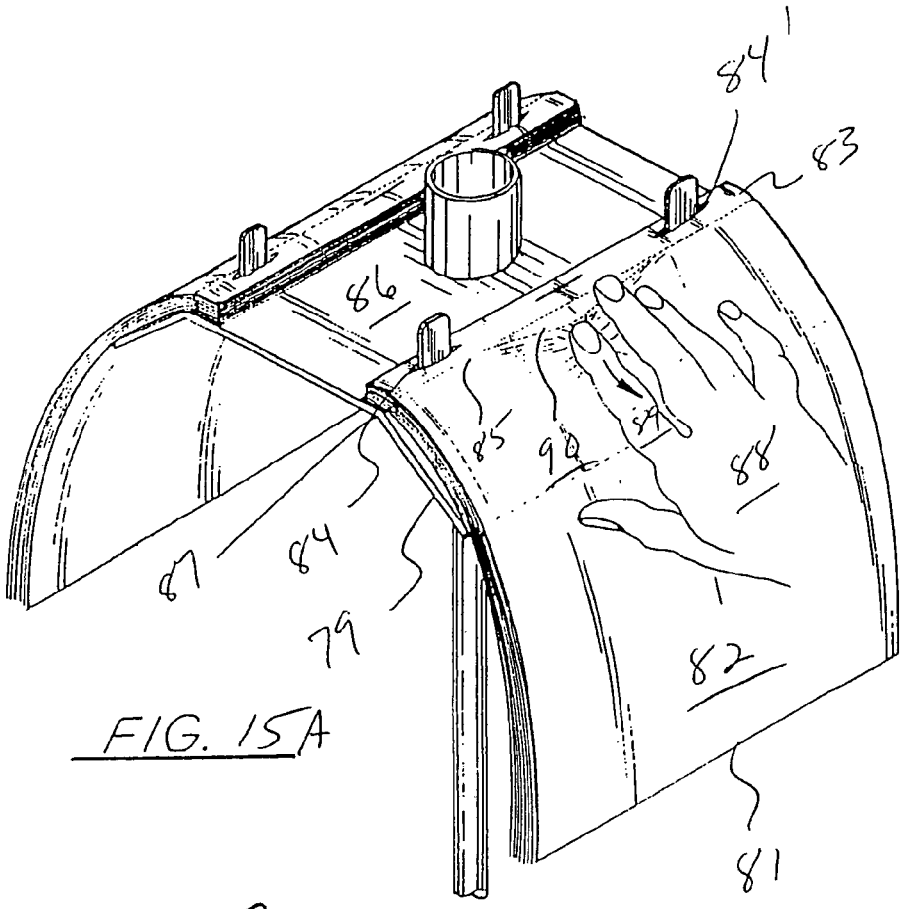
FIGS. 15A-15B illustrate isometric views of the rack of FIGS. 14A-14E, with bag packs mounted thereon, further illustrating sequential views of a user dispensing a bag from the pack.
Figure 15B:
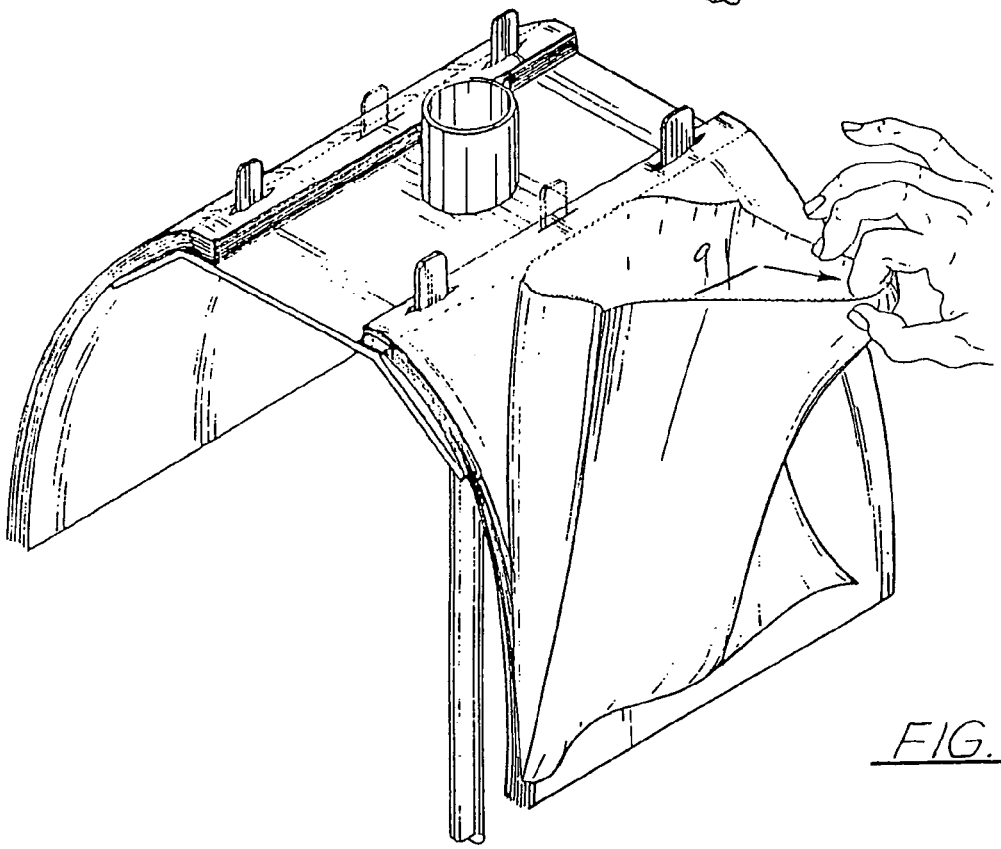

Referring to FIGS. 15A-15B, in use, a bag pack 81 comprising a stack of bags 82 held together via a fused tab portion 83 having support slits 84 formed therein, which bags may be separated from the tab portion via perforation 85, is placed upon the rack such that the support slits 84, 84'8 engage the support members 77, 77' of the rack with the perforation 85 of the bag pack supported above an angled transition zone 87 on the rack, wherein the rack goes from a generally horizontal 86, planar support to a declining support member 79.

A user 88 applies pressure 89 to the top bag, the pressure supported by the declining planar support member 79, then directs said pressure downward 90, so as to separate the top wall of the top bag from the tab via separating the perforation, thereby opening 91 the mouth of the bag, and allowing said top bag to be pulled and removed from the pack.

FIGS. 17A-17D, 18A-18B, and 19A-19B illustrate a third embodiment of the present invention, wherein there is provided an alternative rack and bag pack cover configuration.

Referring to FIGS. 17A-17D, the third embodiment of the rack R' of the present invention includes a vertical support member 101 having first 102 and second 103 ends, the first end 102 engaging a base 104, the second end 103 supporting a top rack 105.

The top rack 105 includes first 110 and second 111, opposing dispenser stations, each dispenser station having a generally horizontally situated support section S formed of sheet meta and having emanating therefrom first 112 and second 112' support members.

As shown, the body of the rack is formed from sheet metal which is bent into shape, and which has punched out bag pack support members 112, 112' configured to engage and hold a bag pack in a manner similar to that indicated in the preferred embodiment of the invention. A third, medially situated support member may also be provided (not shown), depending upon the configuration of the pack to be dispensed.

Continuing with the drawings, the rack includes a declining planar support member 172 emanating from the body in the vicinity of support members 112, 112', which ideally would have a width 180 at least commensurate with the width of the bag pack to be dispensed, the declining planar support member situated at a declining angle from the end situated in the vicinity of the bag pack support members to the opposing end.

The present embodiment of the invention further incorporates a new and unique bag pack holding members 150, 151, configured to hold in place an underlying bag pack, while providing a dispensing area for guiding a user to remove the next bag to be dispensed in an open configuration.

As shown, each bag pack holding member 150 comprises first and second rods 152, 152' having first 153 and second 153' ends, each first end of the rods incorporating opposing laterally emanating end E pieces engaging a pivotal connecting slot 154, 154', each second end of the rods engaging opposing ends of a base plate 155. Each pivotal connecting slot 154 is formed to provide a vertical slot portion to engage the laterally emanating end piece, allowing a pivotal connection while allowing vertical migration of the lateral end piece and associated rod and bag pack cover assembly up or down the formed vertical slot, as t is urged via an underlying bag pack, as will be further discussed infra.

Figure 18A:
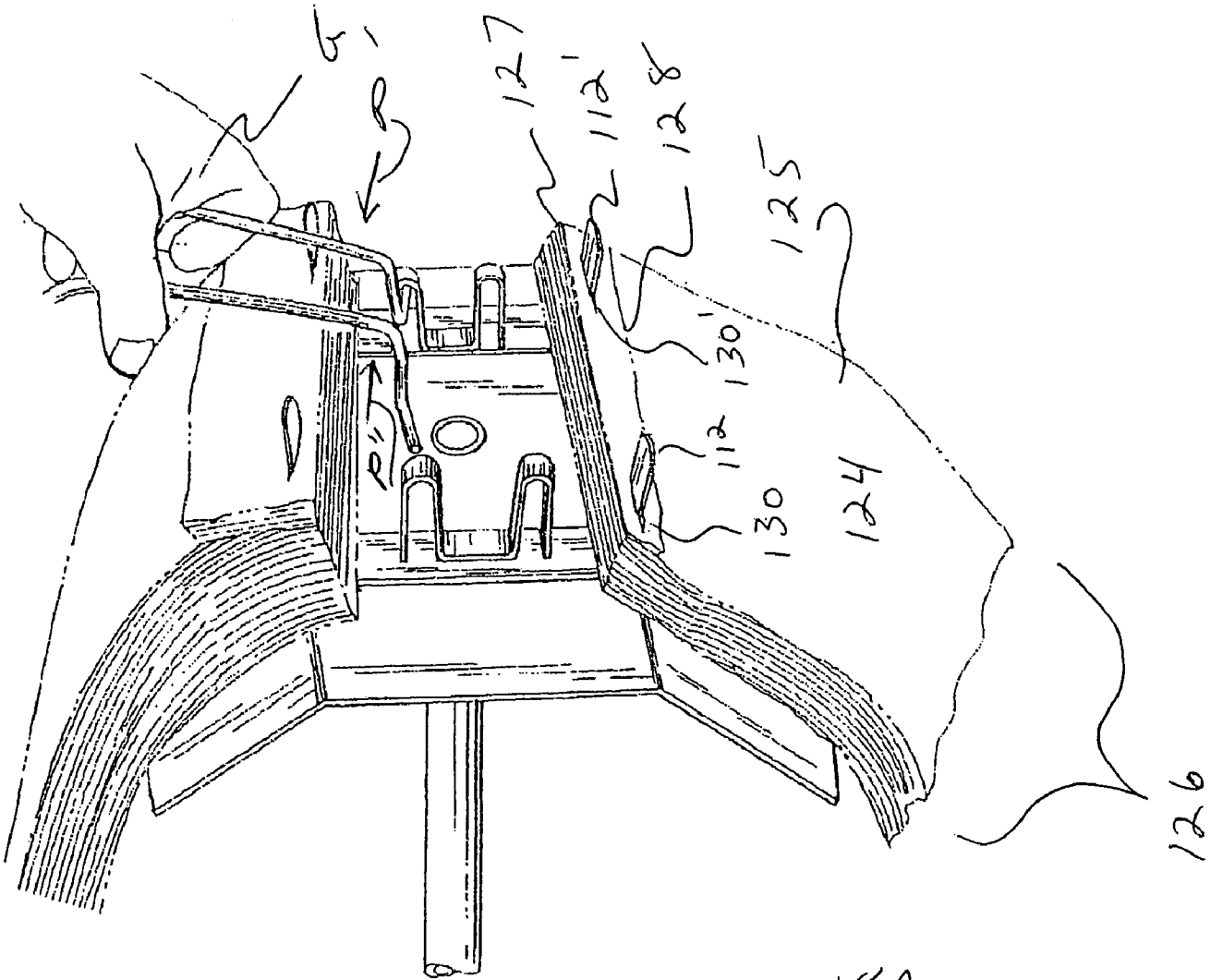
FIG. 18A is an isometric, upper view of the bag rack of FIG. 17A, further illustrating the installation of a bag pack thereupon.
Figure 18B:
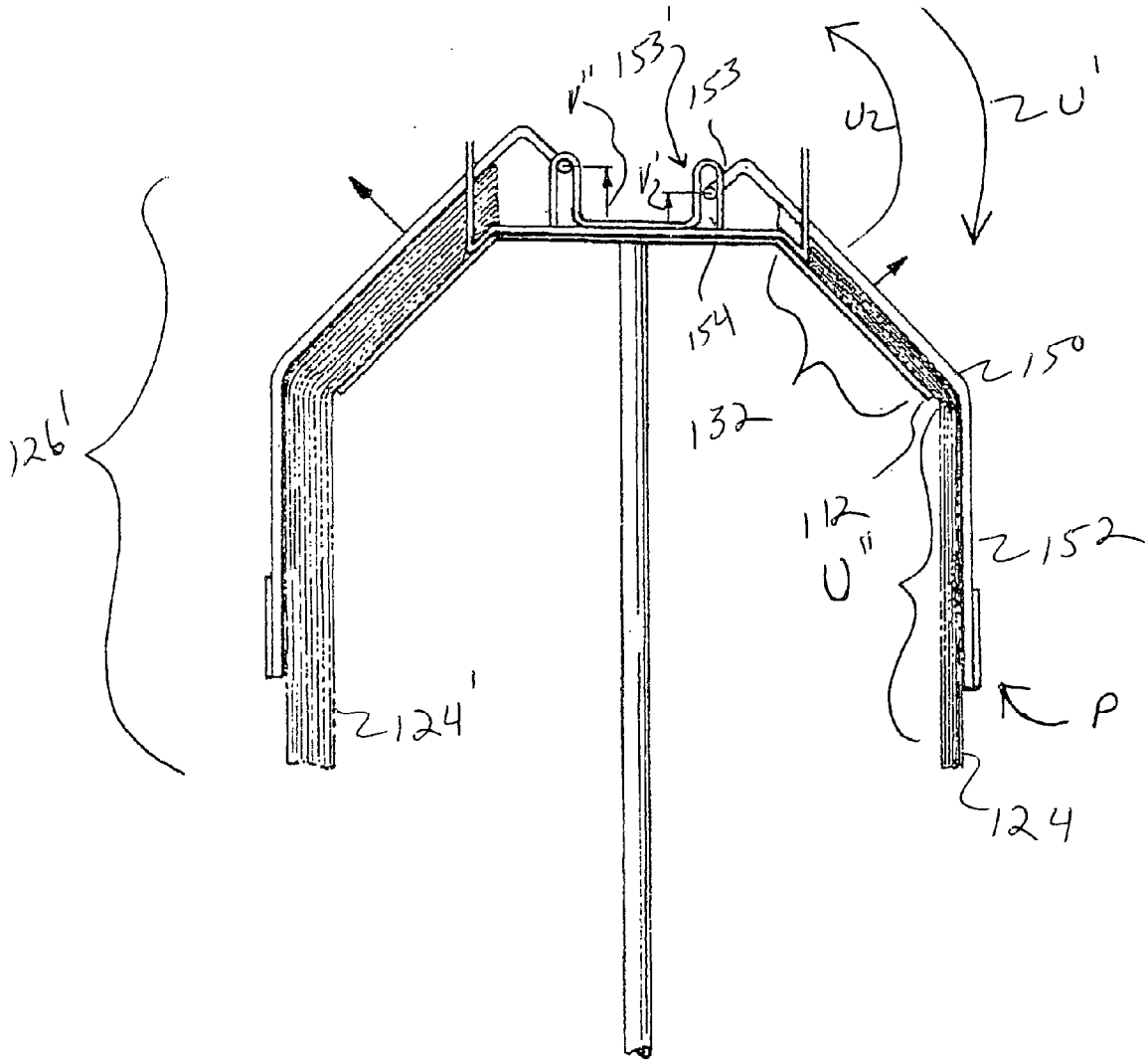
FIG. 18B is a side view of the bag rack of FIG. 18A, illustrating the bag pack covers resting upon the first and second bag packs, respectively.

Continuing with FIGS. 18A and 18B, the present system further includes a bag pack 124, 124' comprising a stack of bags including a top bag 125, each bag pack having a uniform width 126 and length 126'. The bags may be retained in a pack via a heat fused tab portion 127 removably connected to the upper edge forming the mouth of the bag via perforated line 128, the tab portion further having second and first support slits 130', 130 formed there through, configured to engage first and vertical support members 112, 112', respectively. As also shown, the declining planar support member 112 is configured to provide a supported dispensing area 132 under the bag pack for enhanced dispensing of individual bags from the bag stack by a user.

Continuing with the figures, in use, the bag pack holding member 150 may be pivoted upwards U via lifting the base plate (pivoting the first end of the rods engaging the vertically situated pivotal connection slot(s) 154) and placing P the bag pack thereunder, so that the support slits 130, 130' engage their respective vertical support members 112, 112', and the a bag pack holding member 150 is then pivoted downwardly U' to rest upon the bag pack. Accordingly, the first ends 153, 153' of the rods engaging the vertically situated pivotal connection slots may migrate vertically V', V" so that the rods rest generally flatly upon the surface of their respective bag packs. As shown, the rods may be angled in a generally medial portion of the rods to match the contour of the declining planar support member and unsupported portion of the bag pack U", so as to contact the uppermost bag n the bag pack along its length, holding the bag pack down and providing a stable dispensing area.

Referring to FIG. 18A, instead of pivoting the rods upward to install the bag pack, a user may merely grasp the two rods in the vicinity of their first ends and apply pressure P', P" towards Each of said rods removing the lateral ends of the rods from the supporting pivotal connect on slots, remove the bag pack holding member, install the bag pack as above, and reinstall the bag pack holding member by again grasping and applying pressure to the rods in the vicinity of their first ends, then placing the lateral ends of the rods in their respective pivotal connection slots by releasing same.

Figure 19A:
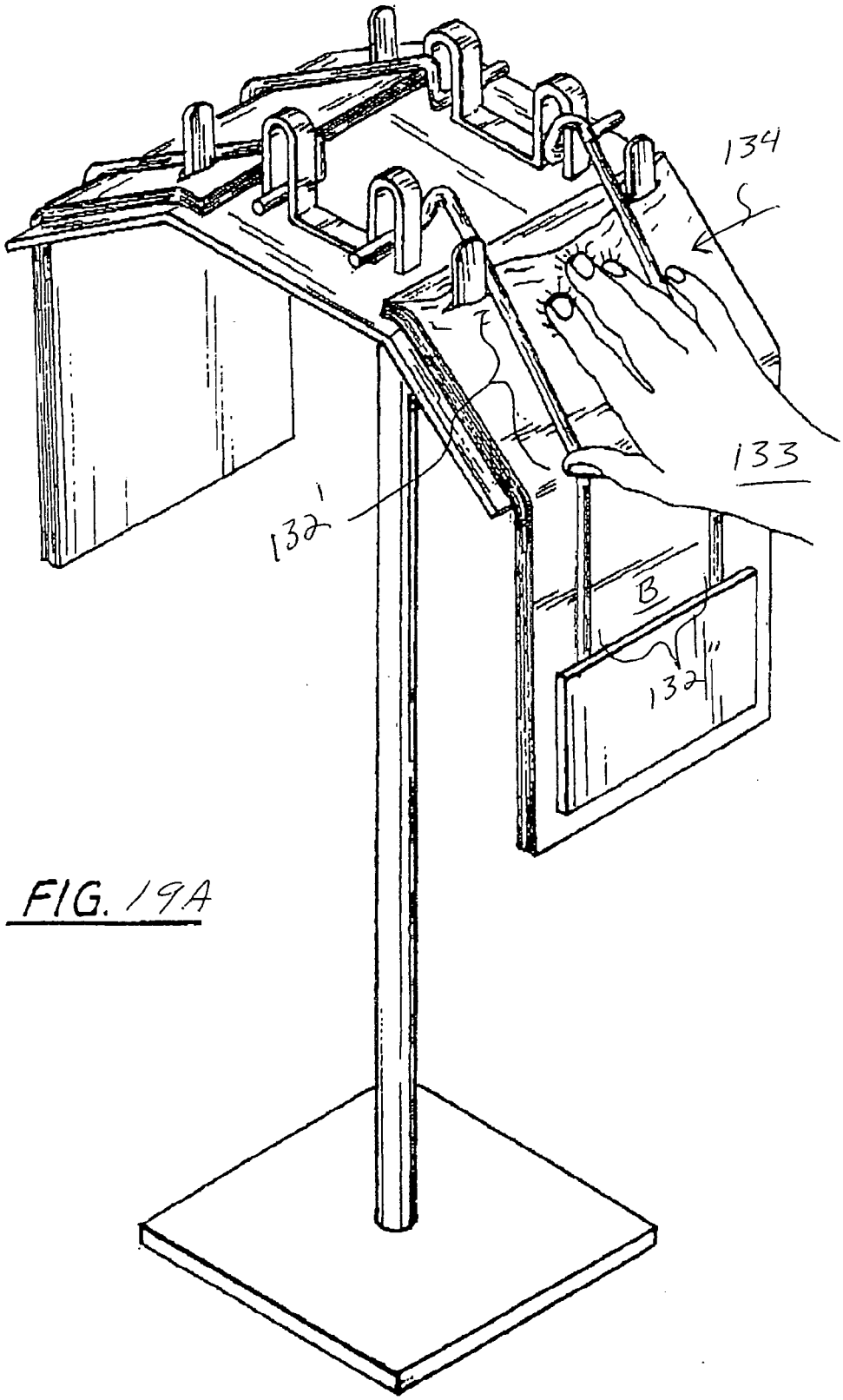
FIG. 19A is an isometric view of the bag pack of FIG. 18A, illustrating the dispensing of a bag between first and second rods of one of the bag pack covers.
Figure 19B:
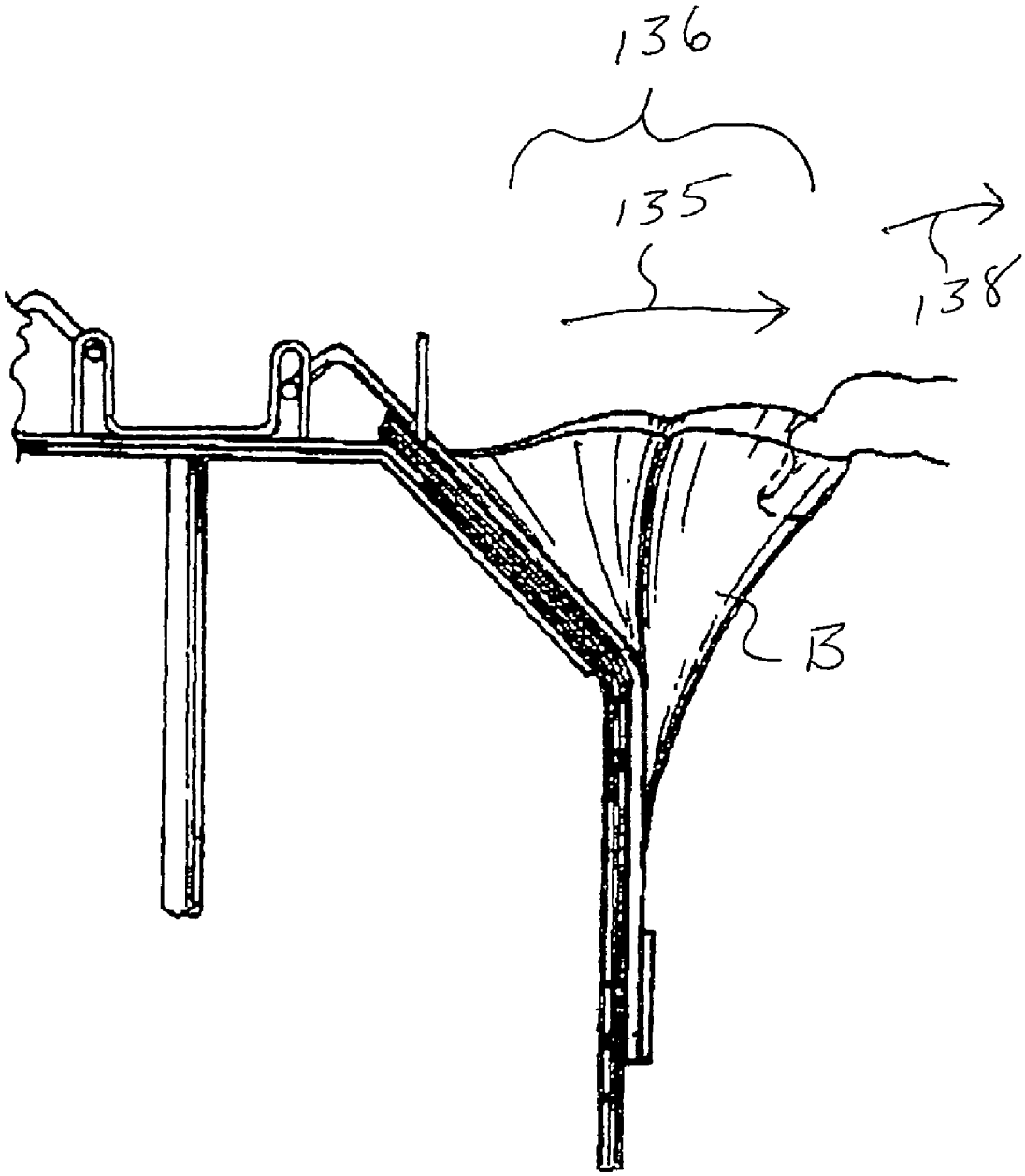
FIG. 19B is a side view of the dispensing of a bag of the invention of FIG. 19A.

Continuing with FIGS. 19A and 19B, in use, the user 133 applies pressure 134 to the top bag B within the supported dispensing area 132 over the planer support, so that the underlying declining planer support area supports the medial area 131 and supported dispensing area 132', 132" of the bag and bag pack, allowing the user to pull 135 the top wall of the bag toward the user, separating 136 the perforated portions, opening bag B, and removing and dispensing 138 same from the pack. In applying pressure to the bag to be dispensed, the user may utilize the underlying declining planer support area to support the bag pack and bag to be dispensed, detaching the perforation holding the top bag from the bag pack while guiding the bag downward, separating the bag from the pack.

As shown, the bag pack holding member forms therein a dispensing area 47 conforming to the dispensing area 132, 132", between the first and second rods and base plate, said first and second rods, and base framing the dispensing area and holding down the edges of the bag pack, providing a frictional means for facilitating the dispensing of the outer bag wall of the next bag to be dispensed. Accordingly, the present embodiment functions in a manner similar to the invention of FIGS. 12A and 12B and 13A-13D.

As with the other embodiments, the bag pack holding member also holds the pack in a flat, uniform posture under windy conditions. It is noted that the dispensing aperture may have formed other than the rectangle shown, and may include other designs, including those incorporating radial lines, depending upon the application and use of the system.

Figure 22:
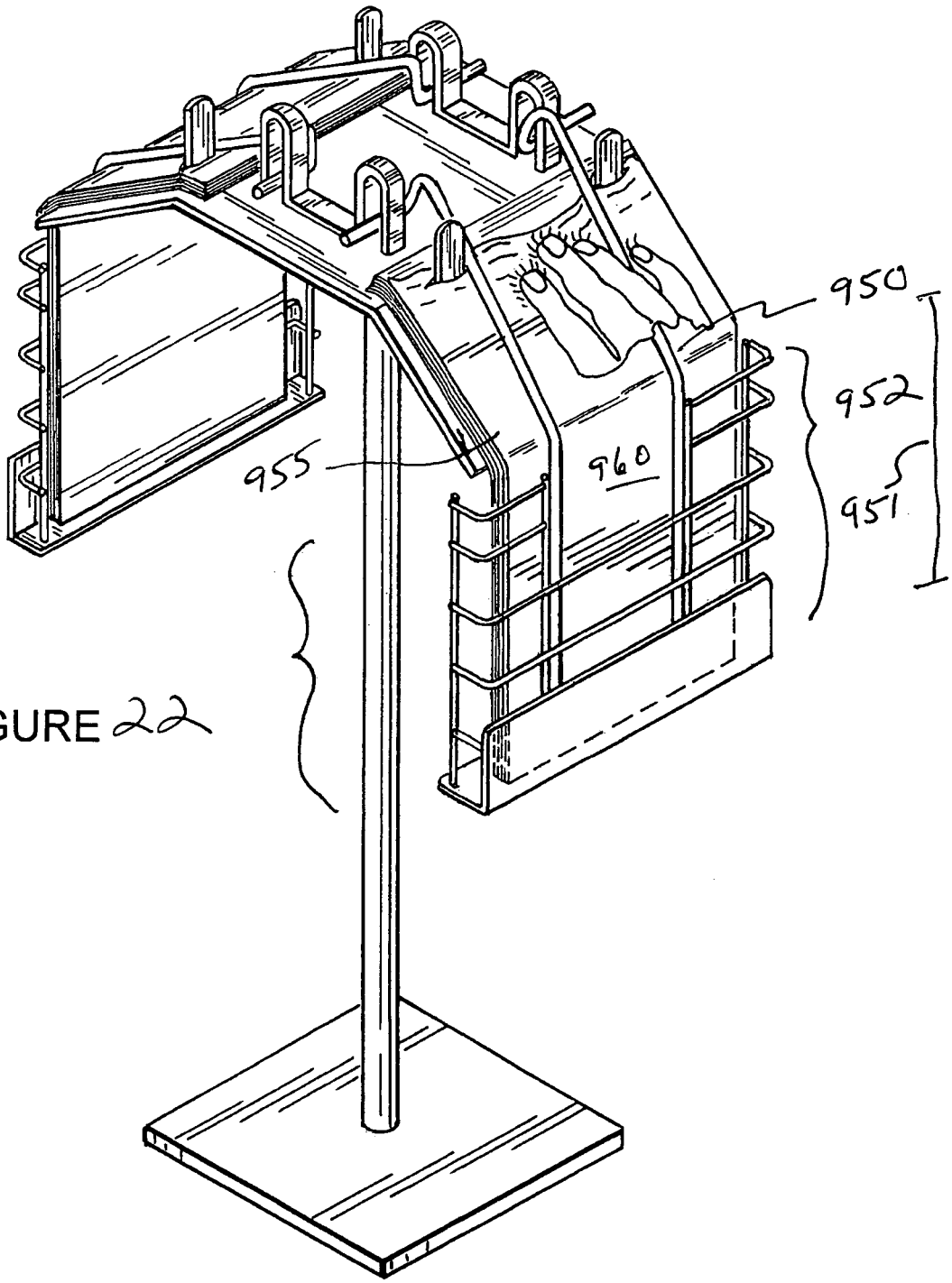
FIG. 22 is an isometric, side view of a fifth embodiment of the invention of FIG. 17A wherein there is further provided side and lower frontal caged area on the pack holding members.

In an alternative embodiment of the present invention, illustrated in FIG. 22, situated about the bag pack holding member 950 is a barrier portion 952 formed about the lower portion 951 of the bag pack holding member 950, and emanating about the lower side portions of the bag pack holding member, so as to provide a barrier about the lower portion of the bag pack and the edge 955 of the bag pack 960, thereby preventing a user from accessing a bag from the side of the pack.

FIGS. 20A-20C and 21A-21B illustrate a fourth embodiment of the present invention, wherein there is provided an alternative rack and bag pack cage-type cover configuration which partially envelopes the bag pack in order to define a dispensing area to prevent a user from accessing bags from the side, bottom, or back of the pack, which can result in dispensing more than one bag, torn bags, bags or pieces of plastic falling upon the floor, etc.

Figure 20A:
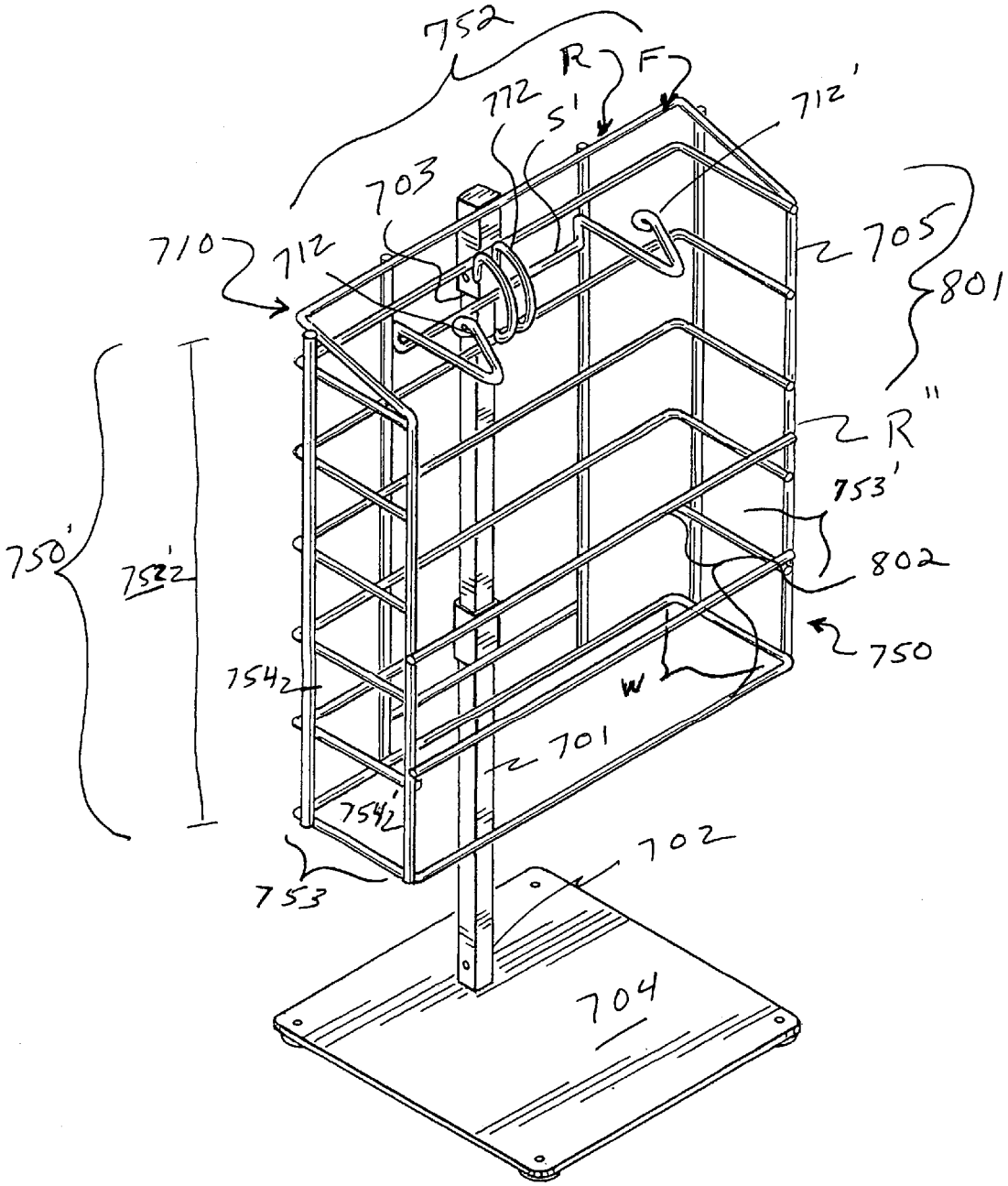
FIG. 20A is an isometric, side view of a fourth, caged embodiment of the rack of the present invention.
Figure 20B:
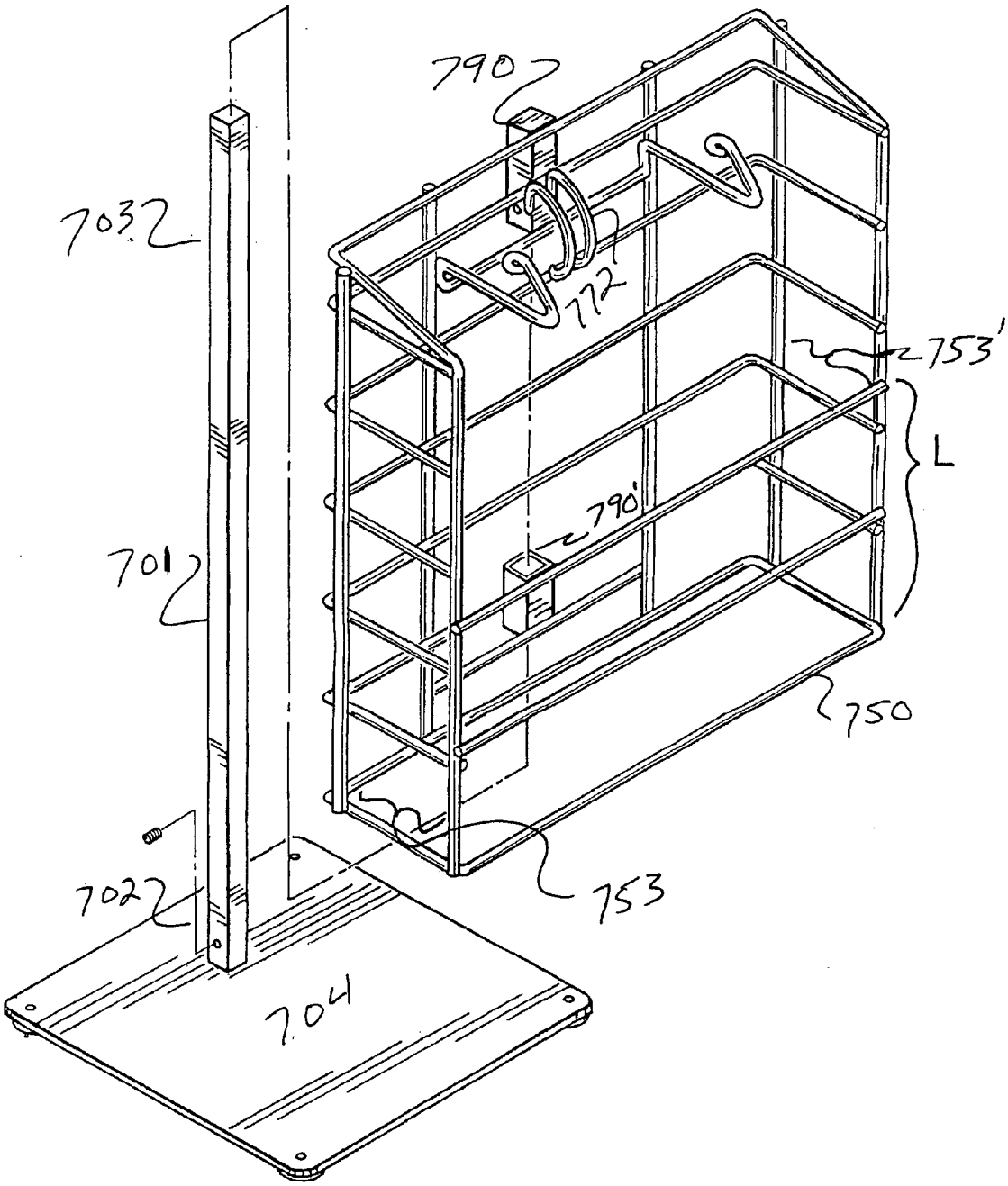
FIG. 20B is an isometric, side view of the invention of FIG. 20A, illustrating the rack separated from the stand.
Figure 20C:
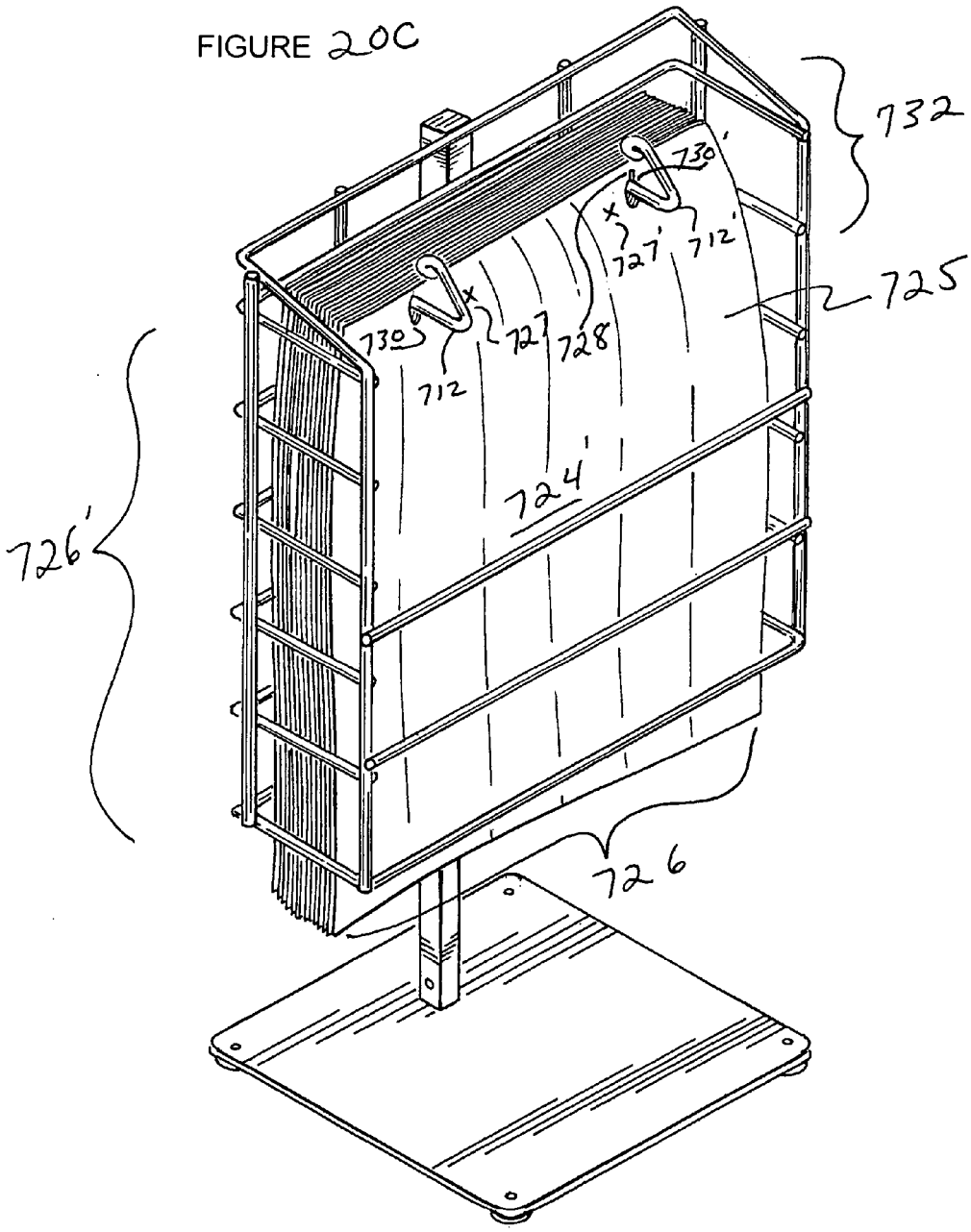
FIG. 20C is an isometric, side view of the invention of FIG. 20A, illustrating a bag pack situated on the rack.
Figure 21A:
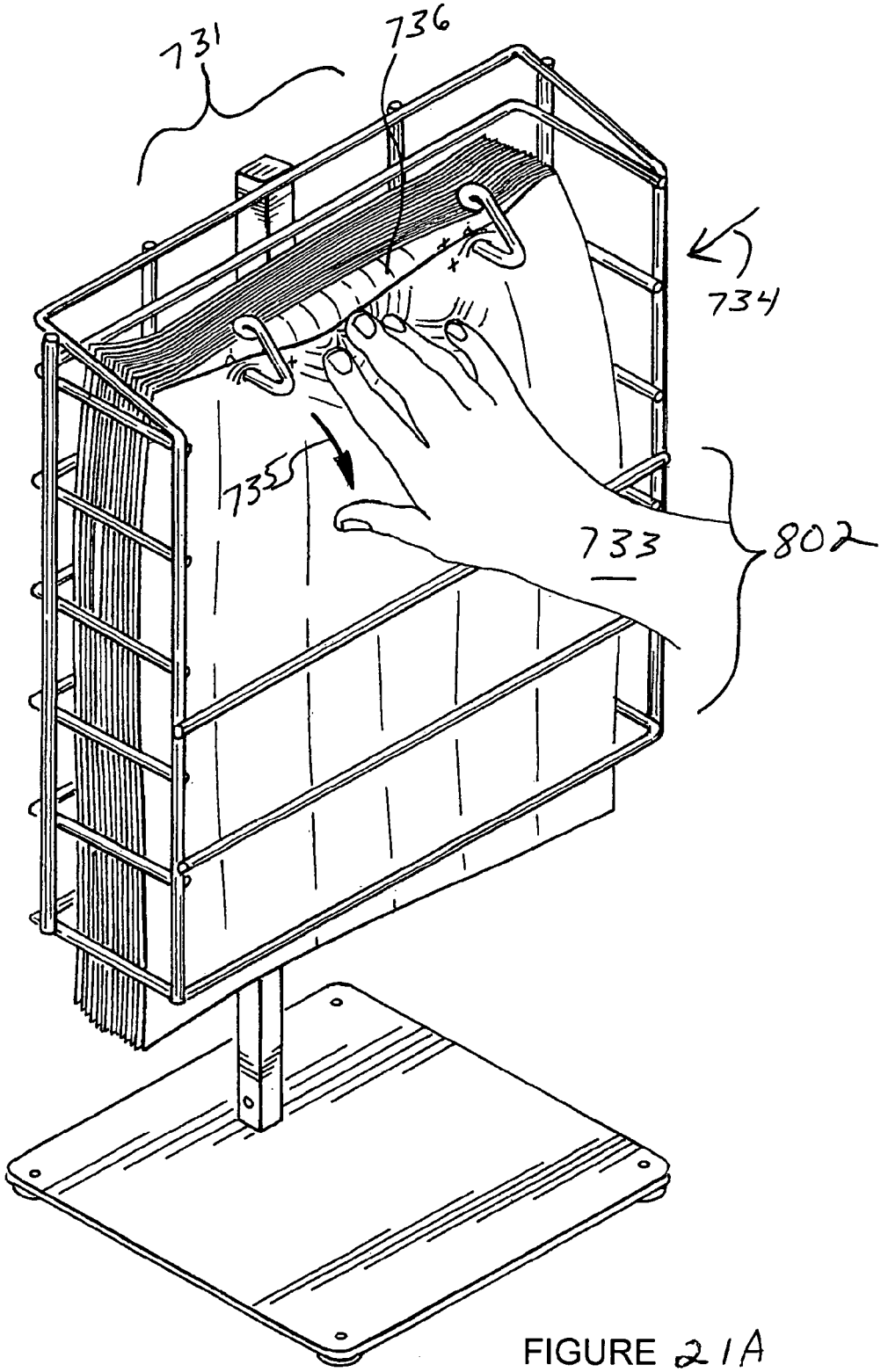
FIG. 21A is an isometric, side view of the invention of FIG. 20A, illustrating a user accessing a top, frontal area of the top bag of a pack of bags held by the rack of FIG. 20A.
Figure 21B:
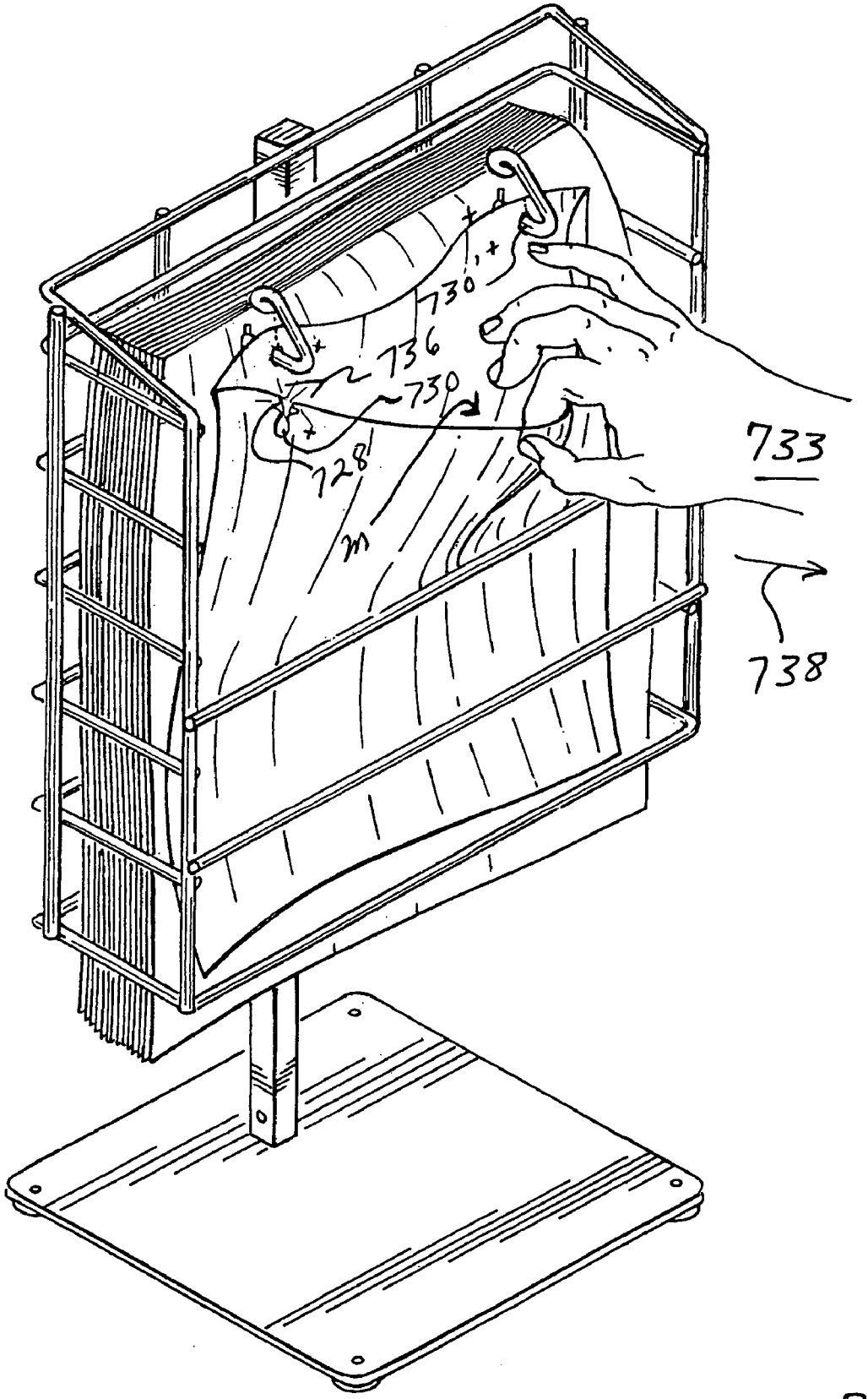
FIG. 21B is an isometric, side view of the invention of FIG. 20A, illustrating a user removing a bag from the rack.

Referring to FIGS. 20A-20C, the fourth embodiment of the rack R" of the present invention includes a vertical support member 701 having first 702 and second 703 ends, the first end 702 engaging a base 704, the second end 703 supporting a rack 705.

The rack 705 includes a 710 dispenser station having a generally horizontally situated support section S' formed of wire and having emanating therefrom first 712 and second 712' support members.

As shown, the body of the rack is formed from wire metal which is bent into shape, and which has formed bag pack support members 712, 712' in the form of a hook or the like to engage and hold a bag pack. A third, medially situated support member may also be provided (not shown), depending upon the configuration of the pack to be dispensed.

Continuing with the drawings, the rack includes a raised medial support 772 emanating from the body between support members 712, 712', the raised medial support member shown formed of bent wire to provide underlying support to the bag pack mounted to the rack and the bag to be dispensed.

The present embodiment of the invention further incorporates a new and unique bag pack holding caged enclosure 750 configured to envelope the side edges and bottom of an underlying bag pack, while providing a dispensing area for guiding a user to remove the next bag to be dispensed in an open configuration, and preventing the user from retrieving a bag from the side edges of the pack.

As shown, the bag pack caged enclosure 750 comprises a back portion 750' mounted to the vertical support member, the back portion having front F and rear R faces, and a width 752 and length 752' greater than the bag pack to be dispensed, the back portion forming a planar guard to prevent access of the rear bags of the bag pack by a user.

The caged enclosure 750 may have mounted thereon a cap 790 which is configured to engage the upper portion 703 of the vertical support member to mount said caged enclosure 750 upon said vertical support member 701. A slide 790' may further be provided in the medial area of the back of the caged enclosure to facilitate secure mounting to the vertical support member 701.

Continuing with the figures, the back portion 750' has opposing first 753 and second 753' side portions emanating from the front F face of the back portion 750', the side portions forming having first 754, and second 754' edges and a width W' there between, the first edge 754 engaging the front face F of the back portion 750'.

Engaging the lower portion L of the second edges 754' of the side portions 753, 753' is a front barrier area 802 which runs generally about the lower medial portion of the side edges, providing an enclosure between the back portion and the front barrier area. An open dispensing area 801 is thereby formed above the front barrier member, providing user access to the upper portion of the top bag in the pack to be dispensed, while the side and back portion of the bag pack is enclosed by the side portions 753, 753' and back portion 750', forming a partial enclosure of the bag pack so that the user can only access the upper front portion of the bag to be dispensed.

Continuing with FIGS. 20A-20C and 21A-21B, the present system further includes a bag pack 724' comprising a stack of bags including a top bag 725, each bag pack having a uniform width 726 and length 726'. The bags may be retained in a pack via star punches 727, 727' situated at the upper edge forming the mouth of the bag, and suspended from the rack via hook (712, 712') apertures 730', 730, having tear through portion 728, so as to provide a tabless bag dispensing system whereby no tab remains on the rack once the pack is dispensed.

Alternatively, the bag pack may have a tab which engages the rack and a perforation line wherefrom the bags are removed from the pack, as shown in the earlier embodiments of the invention supra.

The medial support member 772 is configured to provide a supported dispensing area 732 under the bag pack for enhanced dispensing of individual bags from the bag stack by a user.

Continuing with the Figures, in use, the user 733 applies pressure 734 to the top bag 725 within the supported dispensing area 732 over the medial support member, so that the underlying medial support member supports the medial area 731 and supported dispensing area 732 of the bag and bag pack, allowing the user to pull 735 the top wall of the bag toward the user, separating 736 the tear through portion 728 of the apertures 730, 730' by pulling the support hooks 712, 712' there through, providing an unsupported bag, opening the mouth M of bag, and removing and dispensing 738 same from the pack.

In applying pressure to the bag to be dispensed, the front barrier area 802 forming the lower frontal portion of the rack provides friction to the lower portion of the bag being dispensed as it is being removed therefrom, providing slight resistance and facilitating the opening of the bag mouth as the bag is removed from the rack, the bag then ready for loading upon removal without the need for manually opening the mouth.

Accordingly, the present embodiment functions in a manner similar to the invention of FIGS. 12A and 12B and 13A-13D.

As with the other embodiments, the bag pack holding member also holds the pack in a flat, uniform posture under windy conditions. It is noted that the dispensing aperture may have formed other than the rectangle shown, and may include other designs, including those incorporating radial lines, depending upon the application and use of the system.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A system for dispensing a plastic bag from a plurality of stacked plastic bags to form a pack, comprising: first and second retaining means for releaseably retaining said bags forming said pack; a medial support situated in between said first and second retaining means, said medial support having a declining support piece emanating in declining fashion relative to the horizontal at about said first and second retaining means, said declining support piece formed so as to support said pack in order to enable a user to apply pressure to said plastic bag and receive support thereunder, and a cover having dimensions adequate to cover a portion of said pack, said cover having formed therein a dispensing aperture situated adjacent to said declining support piece, said dispensing aperture situated so as to require a user to contact a bag forming part of said bag pack, said bag situated between said dispensing aperture and said declining support piece.

2. The system of claim 1, wherein said medial support is formed of bent wire.

3. The system of claim 1, wherein said medial support has a declining angle relative to the horizontal within a range of five to ninety degrees relative to the horizontal.

4. The system of claim 3, wherein said retaining means comprises first and second hooks.

5. The system of claim 4, wherein said pack has formed therein first and second support apertures situated so as to engage said first and second retaining means.

6. The system of claim 5, wherein said pack engages said first and second retaining means via said first and second support apertures, such that said pack is supported via said first and second retaining means, and said pack is supported via said medial support member.

7. The system of claim 6, wherein said cover comprises a dispensing frame comprising first and second rods having first and second ends, said first and second rods spaced in parallel fashion and pivotally connected to said medial support at said first end, and a lower cover plate joining said second ends of said first and second rods, said dispensing frame configured to rest upon said pack so as to form a dispensing area defined between the first and second rods.

8. The system of claim 7, wherein said cover is situated to frictionally contact a bag forming said pack when said bag is pulled through said dispensing aperture, while retaining said bags forming said pack in a stacked, aligned manner.

9. The system of claim 8, wherein said bags forming said bag pack are removably attached to said retaining means via tear-through apertures.

10. The system of claim 9, wherein said first and second retaining means and said medial support forms a dispensing station, and wherein said dispensing station is supported via a vertical support having a base.

11. The method of dispensing a plastic bag from a plurality of stacked plastic bags releaseably attached to one another so as to form a pack, comprising the steps of:

a) providing: first and second retaining means for releaseably supporting said pack; a medial support situated between said first and second retaining means, said medial support formed so as to support said pack in order to enable a user to apply pressure to said plastic bag and receive underlying support thereunder; a cover having dimensions adequate to cover a portion of said pack, said cover having formed therein an open area defining a dispensing area situated in the vicinity of said medial support;

b) affixing said pack to said retaining means such that said plastic bag is situated on top of said pack, and said medial support is situated under said pack;

c) applying pressure to said plastic bag in an area on said plastic bag where said plastic bag receives underlying support from said medical support, while utilizing said dispensing area formed in said cover to direct the user to apply pressure to said plastic bag in an area on said plastic bag wherein said plastic bag receives underlying support from said medical support;

d) directing said pressure to said plastic bag away from said retaining means, so as to release said bag from said retaining means and said pack, with said medial support continuing to support said pack in the area in which said pressure is applied;

f) removing said bag from said rack.

12. The method of claim 11, wherein said pack has back, upper and lower front portions, and first and second side edges and wherein said cover referenced in step "a" said cover is formed to-envelope at least a medial portion of said first and second side edges and said lower front portion of said pack. and wherein in step "c" there is provided the additional step of utilizing said cover to prevent said user from accessing the first and second side edges and lower front portion of said pack.

13. The method of claim 11, wherein there is provided the further step of utilizing said cover to retain said pack in a uniform stack, by allowing said cover to form an enclosure for the sides of said pack.

14. A bag dispensing system, comprising: a plurality of stacked, aligned bags detachably secured to one another to form a bag pack; a rack for retaining said bag pack, said rack comprising a dispenser station comprising: first and second retaining means for engaging said bag pack; a medial support situated in between said first and second retaining means, said medial support formed so as to support said pack in order to enable a user to apply pressure to said plastic bag and receive underlying support from said medial support, and a cover having dimensions adequate to cover a portion of said pack, said cover having formed therein a dispensing aperture situated adjacent to said medial support, said dispensing aperture situated so as to require a user to contact a bag forming part of said bag pack, said bag situated between said dispensing aperture and said medial support.

15. The bag dispensing system of claim 14, wherein said bag pack has back, upper and lower front portions, and first and second side edges, and wherein said cover comprises a wire cage enveloping the back, first and second side edges and said lower front portion of said bag pack.

* * * * *